US010021936B2

(12) United States Patent
Lee et al.

(10) Patent No.: US 10,021,936 B2
(45) Date of Patent: Jul. 17, 2018

(54) SOLE FOR AERATED FOOTWEAR

(75) Inventors: Neville Ka Shek Lee, Hong Kong (CN); Chi Kit Chan, Hong Kong (CN); Samuel Sing-Kwong Hui, Hong Kong (CN)

(73) Assignee: Cedar Technologies International Ltd., Hong Kong (CN)

( * ) Notice: Subject to any disclaimer, the term of this patent is extended or adjusted under 35 U.S.C. 154(b) by 853 days.

(21) Appl. No.: 13/813,366

(22) PCT Filed: Jul. 14, 2011

(86) PCT No.: PCT/US2011/043949
§ 371 (c)(1),
(2), (4) Date: Jan. 30, 2013

(87) PCT Pub. No.: WO2012/018490
PCT Pub. Date: Feb. 9, 2012

(65) Prior Publication Data

US 2013/0125424 A1 May 23, 2013

Related U.S. Application Data

(60) Provisional application No. 61/403,894, filed on Sep. 23, 2010, provisional application No. 61/400,941, filed on Aug. 5, 2010.

(30) Foreign Application Priority Data

Feb. 23, 2011 (CN) ..... 2011 1 0048559

(51) Int. Cl.
*A43B 1/00* (2006.01)
*A43B 7/06* (2006.01)
(Continued)

(52) U.S. Cl.
CPC ..... *A43B 7/06* (2013.01); *A43B 1/0018* (2013.01); *A43B 7/081* (2013.01); *A43B 13/16* (2013.01); *A43B 13/183* (2013.01)

(58) Field of Classification Search
CPC ..... A43B 1/0018; A43B 7/06; A43B 7/081; A43B 13/16; A43B 13/183
(Continued)

(56) References Cited

U.S. PATENT DOCUMENTS 1,160,810 A * 11/1915 Abramowitz ..... A43B 7/142 36/147
1,176,445 A 3/1916 Haran
(Continued)

FOREIGN PATENT DOCUMENTS

GB 2 183 446 A 6/1987

OTHER PUBLICATIONS

U.S. Patent and Trademark Office, International Search Report in International Patent Application No. PCT/US 11/439949, (dated Dec. 23, 2011).

(Continued)

*Primary Examiner* — Sharon M Prange
(74) *Attorney, Agent, or Firm* — Leydig Voit and Mayer

(57) ABSTRACT

A sole for aerated footwear having an elongate body with a lower surface, a device attached to the body, and an operating member, arranged to move away from and towards the body in a direction transverse to the longitudinal extent of the body as the sole bends to disengage and unbends to engage a floor, for operating the device. The device is attached to the body, engageable with the operating member, and is expandable from, or further away from, the lower surface of the body, upon movement of the operating member away from the body.

20 Claims, 17 Drawing Sheets

(51) Int. Cl.
*A43B 7/08* (2006.01)
*A43B 13/18* (2006.01)
*A43B 13/16* (2006.01)

(58) Field of Classification Search
USPC ..... 36/3 R, 3 B, 102
See application file for complete search history.

(56) References Cited

U.S. PATENT DOCUMENTS

| | | | | |
|---|---|---|---|---|
| 2,354,407 | A * | 7/1944 | Shaks | A43B 7/06 36/147 |
| 4,760,651 | A * | 8/1988 | Pon-Tzu | 36/3 B |
| 4,856,208 | A | 8/1989 | Zaccaro | |
| 6,044,577 | A * | 4/2000 | Clark | 36/3 B |
| 8,872,362 | B2 | 10/2014 | Lee et al. | |
| 2001/0042320 | A1* | 11/2001 | Lindqvist et al. | 36/27 |
| 2004/0068891 | A1* | 4/2004 | Wang | A43B 1/0018 36/27 |
| 2006/0156575 | A1 | 7/2006 | Lo | |
| 2013/0118028 | A1* | 5/2013 | Yoon | 36/27 |

OTHER PUBLICATIONS

State Intellectual Property Office of the People's Republic of China, Office Action in Chinese Patent Application No. 201110048559.8 (dated Oct. 30, 2014).

* cited by examiner

SOLE FOR AERATED FOOTWEAR

The present invention relates to a sole for aerated footwear. More particularly, although not exclusively, the invention relates to a modified sole and a method of making the same.

BACKGROUND OF THE INVENTION

It has been known that there are numerous examples of footwear mechanism actuated by means of heel-based pressure, applied when the user steps down. The most common being a weight-based pump or any pumps stowed inside the heel/sole in general of ventilating footwear. The sole or the heel must be thickened to give room for the pump. This affects the appearance of the footwear. The size, volume and sometimes, the shape of the pump are substantially limited by the shape, size and volume of the heel/sole. Also, this type of footwear is known to be uncomfortable and affects the stability of the footwear because of the vertical heel movement required to actuate the mechanism.

Thus in the few commercialized designs, the pump has been made to be quite small embedded within the sole thus limiting the negative impacts on stability but also adversely affecting the ventilating abilities of the pump as well.

Ventilating footwear with pumps actuated by substantially linear drive mechanism is available. However, the limitation on the shape, size and volume of the pump remains substantial as long as the pump is stowed inside the sole.

OBJECT OF THE INVENTION

It is an object of the present invention to overcome or substantially ameliorate at least one of the above disadvantages.

SUMMARY OF THE INVENTION

There is disclosed herein according to the first aspect of the invention a sole for aerated footwear, comprising a elongate body having a lower surface, a device attached to the body, and an operating member, arranged to move away from and towards the body in a direction transverse to the longitudinal extent of the body as the sole bends to disengage and unbends to engage a floor, for operating the device, wherein the device is attached to the body, engageable with the operating member and is expandable from or further away from the lower surface of the body upon movement of the operating member away from the body.

Preferably, the operating member is operable to locate an outer part of the device at a spaced-apart position from the lower surface as the sole bends to disengage from the floor.

More preferably the device is sandwiched between the body and the operating member.

More preferably, the operating member comprises first and second operating parts, the second operating part is engageable with the first operating part for moving by the first operating part.

Yet more preferably, the second operating part is connected to the first operating part for moving by the first operating part so as to change direction of drive generated by the first operating part.

Preferably, the second operating part is connected to the first operating part by a pivot.

More preferably, the second operating part is slidably or pivotally connected to the first operating part.

Yet more preferably, the operating member includes a third operating part which is engageable with the second operating part for moving by the second operating part. It is preferable that the third operating part is slidably connected to the second operating part for sliding relative to the second operating part as it moves by the first operating part to thereby change the direction of drive generated by the second operating part.

Preferably, the device is at least partly embedded in the body.

It is preferable that the sole for aerated footwear includes a lock with the body lockable to restrict expanding of the device.

More preferably, the lock is slidable to lock and unlock.

Yet more preferably the lock is adjustable to restrict expanding of the device in a controlled manner.

It is preferable that the operating member is substantially inelastic. More preferable the operating member comprises a resilient biasing means.

It is preferable that the resilient biasing means forms at least part of an elbow spring.

Preferably, the operating member comprises a roller at one end in proximity to the device.

More preferably, the device comprises a pump.

Advantageously, the pump has a body and an opening at top of the body.

Yet more preferably, the opening comprises a valve.

Preferably, the pump having a cylindrical, rectangular or trapezoidal prismatic shape.

More preferably, the sole for aerated footwear includes an intermediate portion along length of the sole where the pump is located.

Yet more preferably, the device comprises a membrane.

It is preferable that the sole for aerated footwear includes a gap between the operating member and the lower surface of the body upon movement of the operating member away from the body.

It is preferable that the sole for aerated footwear includes a covering member which covers the gap and protects it against entrance of foreign objects.

It is preferable that the operating member is made of a material selected from a group of material comprising metal, EVA, nylon, nylon 6, nylon 6-6, ABS, acrylic, PBT, PC, PP, PPS, PBT, PET, TPU, TPR, carbon fibre, graphite, aluminium, steel and iron.

It is preferable that the device is made of a material selected from a group of material comprising metal, EVA, nylon, nylon 6, nylon 6-6, ABS, acrylic, PBT, PC, PP, PPS, PBT, PET, TPU, TPR, carbon fibre, graphite, aluminium, steel and iron.

There is disclosed herein according to the second aspect of the invention a method of assembling a sole for aerated footwear comprising the steps of providing a elongate body having a lower surface, providing a device, attaching the device to the lower surface of the body, providing an operating member for operating the device, attaching a first end of the operating member to a part of the body, and an opposite second end of the operating member is engageable with the device, the operating member is arranged to move towards and away from the body in a direction transverse to the longitudinal extent of the body as the sole bends to disengage and unbends to engage a floor, for operating the device, the device is expandable from or further from the lower surface of the body upon movement of the operating member away from the body.

It is preferable that the operating member comprises first and second operating parts, the second operating part is engageable with the first operating part for moving by the first operating part.

Preferably the method includes the step of connecting the second operating part to the first operating part for moving by the first operating part so as to change direction of drive generated by the first operating part.

More preferably the method includes the step of providing a third operating part which is engageable with the second operating part for moving by the second operating part.

It is preferable that the method includes the step of slidably connecting the third operating part to the second operating part for sliding relative to the second operating part as it moves by the first operating part to thereby change the direction of drive generated by the second operating part.

Preferably, the device comprises a pump.

More preferably, the device comprises a membrane.

Advantageously, the operating member is made of a material selected from a group of material comprising metal, EVA, nylon, nylon 6, nylon 6-6, ABS, acrylic, PBT, PC, PP, PPS, PBT, PET, TPU, TPR, carbon fibre, graphite, aluminium, steel and iron.

More advantageously, the device is made of a material selected from a group of material comprising metal, EVA, nylon, nylon 6, nylon 6-6, ABS, acrylic, PBT, PC, PP, PPS, PBT, PET, TPU, TPR, carbon fibre, graphite, aluminium, steel and iron.

BRIEF DESCRIPTION OF THE DRAWINGS

The invention will now be more particularly described, by way of example only, with reference to the accompanying drawings, in which.

DETAILED DESCRIPTION OF PREFERRED EMBODIMENTS

Figure 1A:
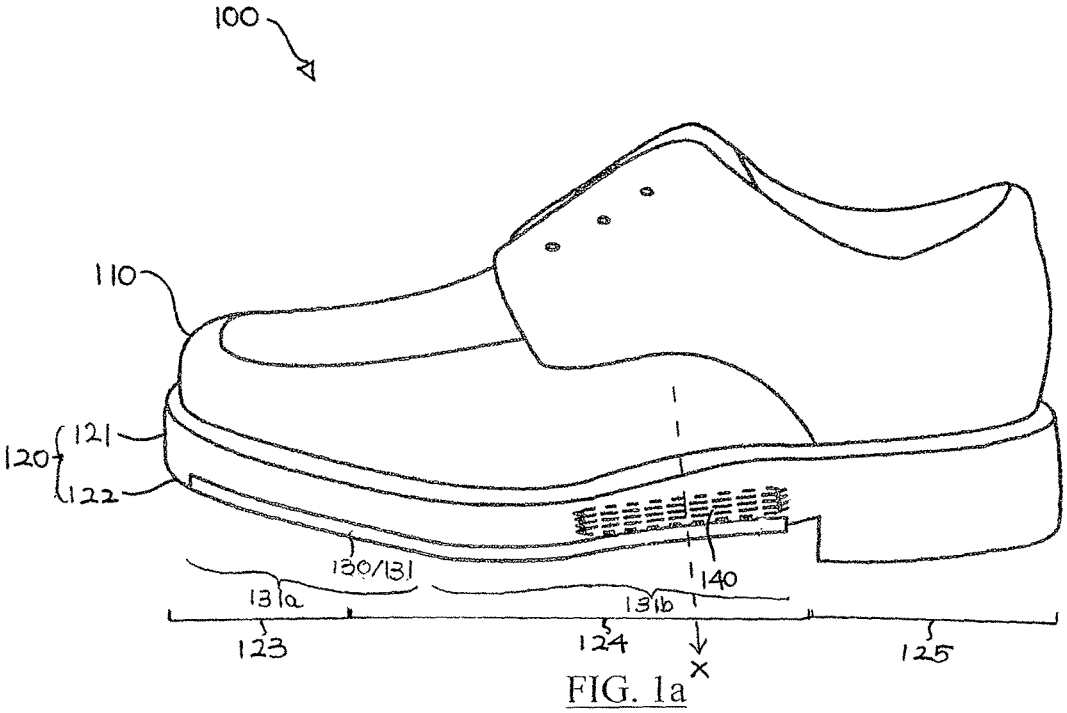
FIG. 1*a* is a side view of aerated footwear comprising an embodiment of a sole in accordance with the invention when the sole is unbent.

Referring to FIGS. 1 to 9*b* of the drawings in general, there is shown a sole 120 for footwear 100, preferably aerated footwear, embodying the invention. The sole 120 includes an elongate body 121 which has a lower surface 122, which may include the lower surface of a heel of the footwear 100, and a certain length and thickness to accommodate at least a portion of the operating member 130 for operating a device 140 that is expandable beyond the lower surface 122 of the body 121. The expansion and compression of the device 140 make possible ventilation in the footwear 100. The device 140 is expandable from the lower surface 122, making good use of space between the body 121 and the floor when the sole 120 bends.

Nine different embodiments of the sole 120 in accordance with the invention are shown in FIGS. 1*a* and 1*b*, 2*a* and 2*b*, 3*a* and 3*b*, 4*a* and 4*b*, 5*a* and 5*b*, 6*a* and 6*b*, 7*a* and 7*b*, 8*a* and 8*b*, 9*a* and 9*b* respectively. Each of the embodiments has a slightly different operating member 130 which in general comprises an operating member 130 with one end 131*a*/132*a* embedded within the body 121 proximate the lower surface 122. A part 131*b*/132*b* of the operating member 130 or whole of the operating member 130 is arranged to move away from and towards the body 121 in a direction transverse to the longitudinal extent of the body 121 as the sole 120 bends to disengage and unbends to engage a floor, for operating the device 140.

In the embodiments as shown in FIGS. 1*a* to 3*b* and 8*a* to 9*b*, the device 140, is preferably a concertina pump, with its upper surface fixedly adhered to, preferably partly embedded within, an intermediate portion 124, along the longitudinal extent of the body 121, advantageously next to the heel of the sole 120. The pump 140 is preferably sandwiched between the body 121 and the operating member 130/131. The pump 140 is expandable beyond the lower surface 122 upon relative movement of at least a part 131*b*/132*b* of the operating member 130 or the whole of the operating member 130 away from the body 121, as the sole 120 bends and is compressible towards and preferably into the body 120, upon relative movement of at least a part 131*b*/133*b* of the operating member 130 or the whole of the operating member 130 towards the body 121 as the sole 120 flattens. The volume, size, and shape of the pump 140 are more flexible as they are generally not being limited by the shape, volume, and size of the sole 120 or the heel portion.

In the embodiments as shown in FIGS. 4*a* to 7*b*, the device 140 is preferably a membrane. The membrane 140 is made of a material that is preferably elastic and/or resilient. The membrane 140 has a tendency to return to its default shape. The device 140 in each of the embodiments is attached to the body 121, engageable with the operating member 130 and is expandable from or further away from the lower surface 122 of the body 121 upon movement of the operating member 130 away from the body 121.

The body 120 has three portions, a front portion 123 and a rear portion 125 sandwiching the intermediate portion 124. Preferably, the front portion 123 and the intermediate portion 124 are resiliently deformable and are elastic such that the sole 120 can be bent or unbent when a wearer moves his foot, such as during walking or running.

Figure 1B:
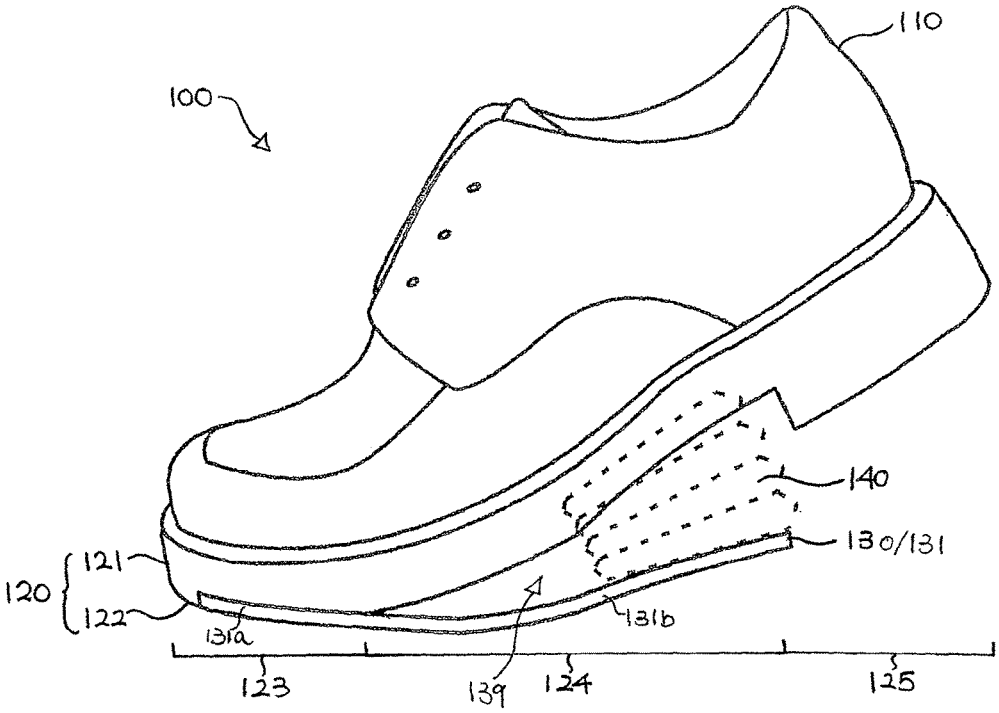
FIG. 1*b* is a side view of the sole in FIG. 1 when it is bent.

Now referring to the first embodiment of the sole 120 in accordance with the invention as shown in FIGS. 1*a* and 1*b*, the operating member 130/131 has an end portion 131*a* embedded in or on the lower surface 122 of the front portion 123 of the body 121. The rest of the operating member 130/131 is allowed to move towards and away from the body 121 with an opposite end portion 131*b* affixed or adhered to a lower surface of the pump 140 such that the pump 140 is compressed or expanded, with or by movement of the end portion 131*b* of the operating member 131 towards and away from the body 121; or with or by movement of the body 121 towards and away from the end portion 131*b* of the operating member 130/131. The operating member 130/131 is a resiliently biasing means with a default shape, preferably extending generally horizontal along its length, and has a tendency to maintain its default shape. As the sole 120 bends, the body 121 moves relatively away from the end portion 131*b* of the operating member 130/131, as the operating member 131 has a tendency to maintain its generally horizontal default shape, the pump 140 is expanded to compensate the increased distance between the body 121 and the end portion 131*b* of the operating member 130/131. Shape of the pump 140 is likely to be distorted, as compared to its expanded state when drive expanding the pump 140 is generally along main longitudinal axis X. The pump 140 in the first embodiment is expanded by the operating member by the operating member 130/131 and the drive is deflected relative to the main longitudinal axis X.

Figure 2A:
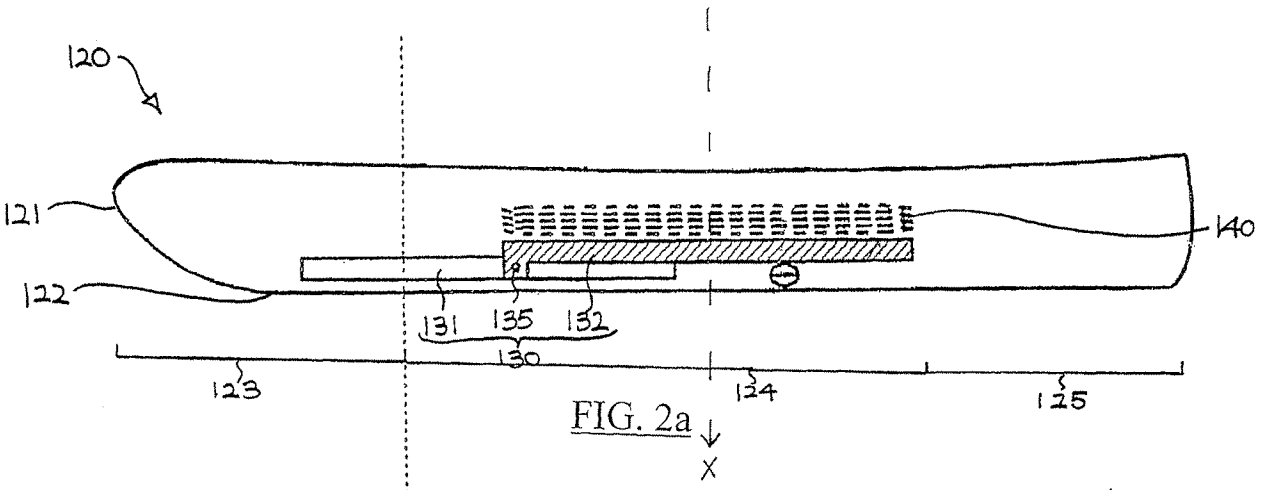
FIG. 2*a* is a longitudinal cross-sectional view of a second embodiment of a sole in accordance with the invention when the sole is unbent.
Figure 2B:
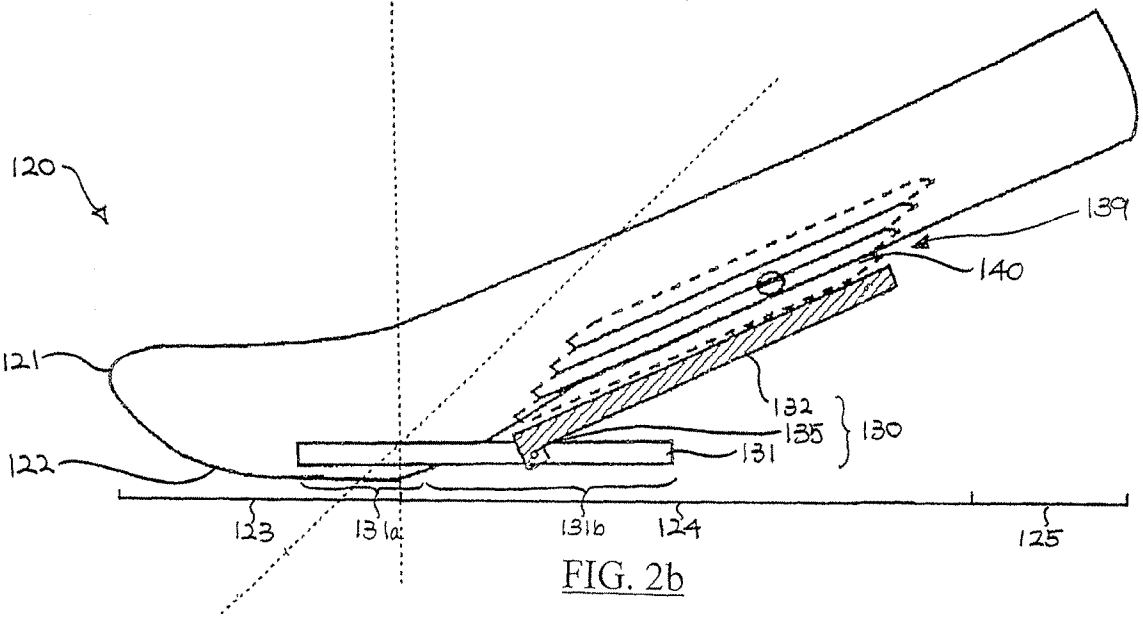
FIG. 2*b* is a longitudinal cross-sectional view of the sole in FIG. 2*a* when it is bent.

In the second embodiment of the sole 120 in accordance with the invention as shown in FIGS. 2*a* and 2*b*, the operating member 130 includes two operating parts, first and second operating parts 131 and 132. The second operating part 132 is engageable with, and being movable by or with movement of the first operating part 131. Preferably the second operating part 132 is connected to the first operating part 131 to change direction of the drive generated by the first operating part 131. The operating parts 131 and 132 are connected to one another by a pivot 135 The second operating part 132 is affixed or adhered to a lower surface of the pump 140 such that the pump 140 is compressed or expanded, with or by relative movement of the end portion 131*b* of the operating parts 131 and the relative movement of the whole of the operating part 132 towards and away from the body 121; or with or by relative movement of the body 121 towards and away from the end portion 131*b* of the operating part 131, and the whole of the operating part 132. This arrangement allows for a slightly less aggressive expansion of the pump 140, as shown in FIG. 2*b*, and reduces the stress of overstretching the pump 140 when the sole is bent vigorously.

Same as the first embodiment, the pump 140 is distorted as it is expanded by a drive, generated by the second operating part 132, that is deflected relative to the main longitudinal axis X of the pump 140.

Figure 3A:
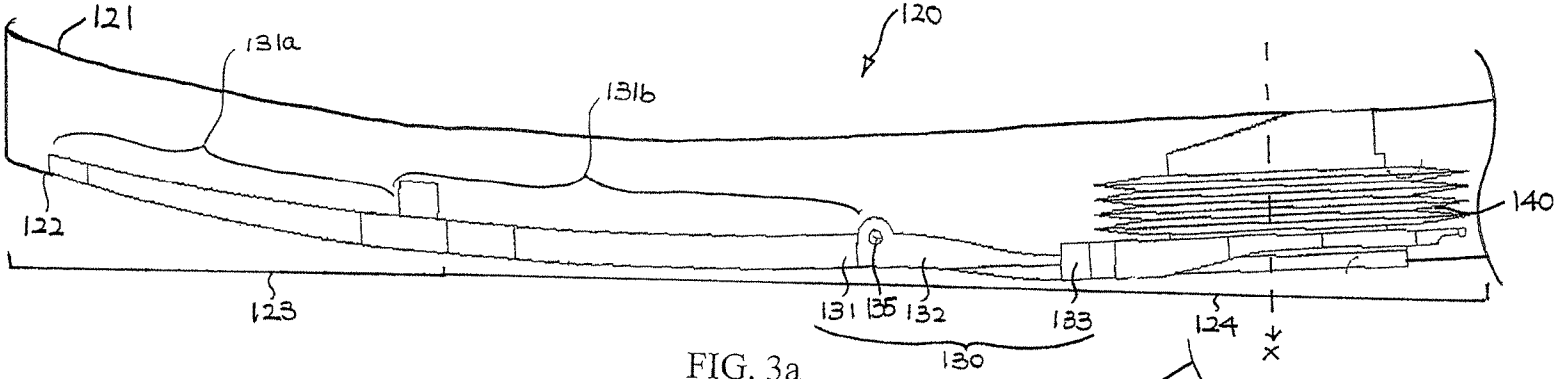
FIG. 3*a* is a longitudinal cross-sectional view of a third embodiment of a part of a sole in accordance with the invention when the sole is unbent.
Figure 3B:
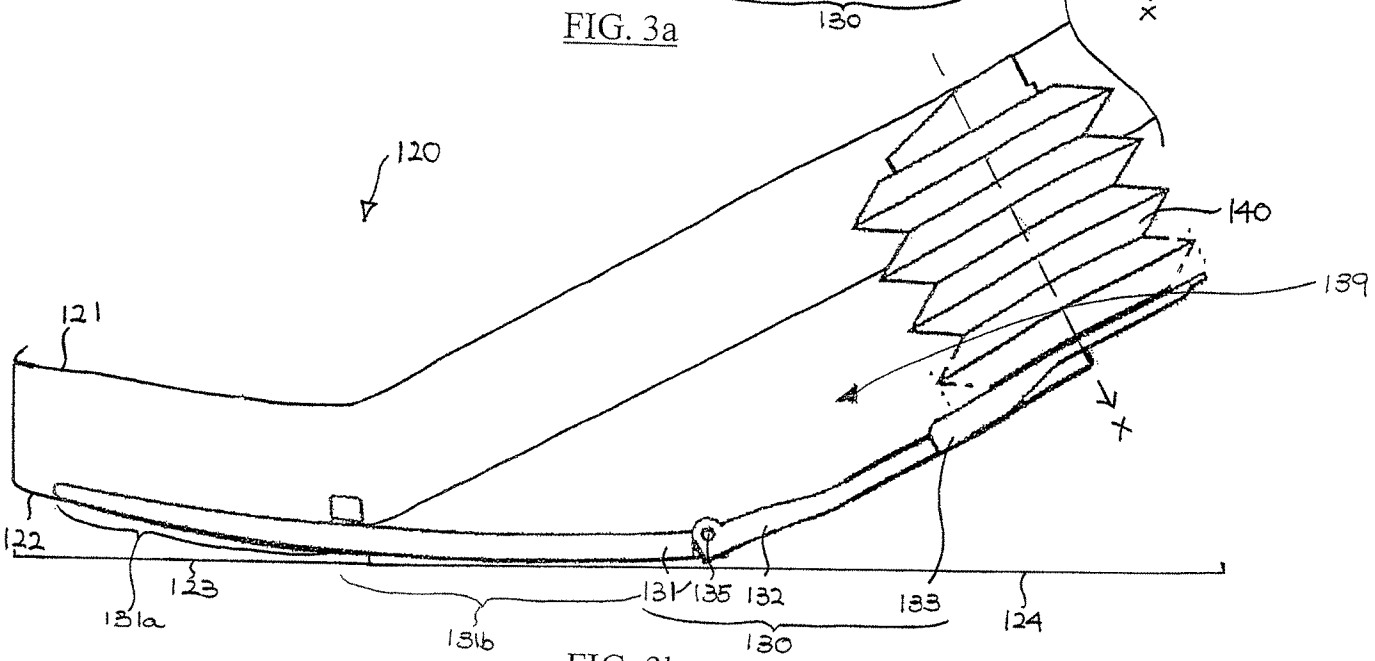
FIG. 3*b* is a longitudinal cross-sectional of the part of the sole in FIG. 3*a* when it is bent.

The third embodiment of the sole 120 as shown in FIGS. 3*a* and 3*b* allows a substantially undistorted expansion of the pump 140 by the application of a third operating part 133 engageable with, preferably connected to, and more preferably, slidably connected to the second operating part 132. The second operating part 132 is telescopically inserted into a portion of the third operating part 133 as shown in FIG. 3*a* to thereby permit sliding movement of the third operating part 133, preferably generally horizontal along its length, relative to the second operating part 132 upon movement of the end portion 131*b* of the first operating part 131 and the whole of the second operating part 132 away from and towards the body 121 as the sole 120 bends and unbends. Sliding connection between the second and third operating parts 132 and 133 changes direction of drive generated by the second operating part 132. The third operating part 133 is affixed or adhered to a lower surface of the pump 140 to compress or expand the pump 140, with or by movement of the end portion 131*b* of the operating part 131 and movement of the whole of the operating parts 132 and 133 towards and away from the body 121; or with or by movement of the body 121 towards and away from the end portion 131*b* of the operating part 131, and the whole of the operating parts 132 and 133. The drive generated by the third operating part 133 is generally or substantially parallel to the main longitudinal axis X of the pump 140 towards and away from the body 121 such that, in an ideal condition, permits undistorted expansion of the pump 140 as the sole 120 bends and unbends.

Figure 4A:
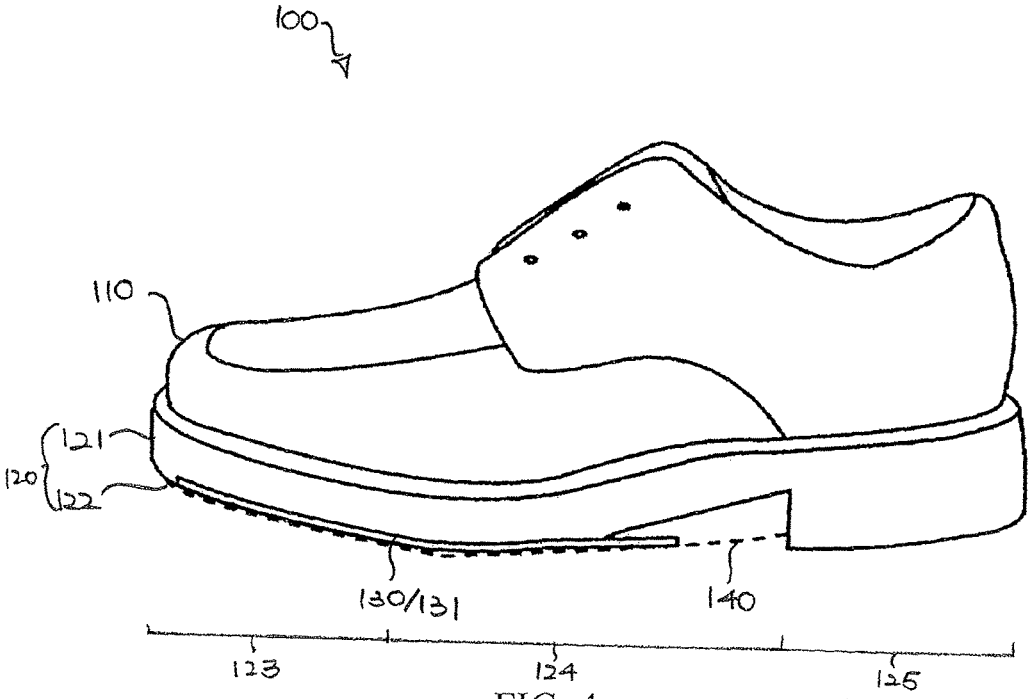
FIG. 4*a* is a side view of a fourth embodiment of a sole in accordance with the invention when the sole is unbent.
Figure 4B:
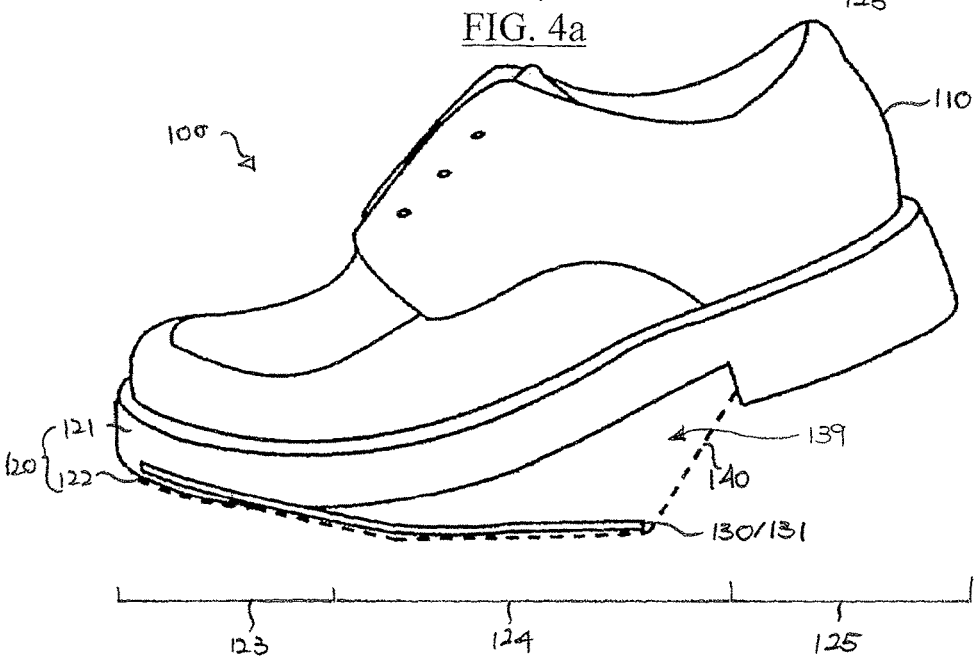
FIG. 4*b* is a side view of the sole in FIG. 4*a* when it is bent.

A fourth embodiment is shown in FIGS. 4*a* and 4*b*. It is a variant of the embodiment as shown in Figures 1*a* and 1*b*. The device is in the form of a membrane 140. One end of the membrane 140 engages, and preferably is attached to, the body 121 near its tip. The membrane 140 is engageable and preferably engages, covers, and encloses the operating member 130 from below. Another end of the membrane 140 engages, and preferably is attached to, the body 121 adjacent the heel. The membrane 140 runs generally under and along the lower surface 122 of the body 121 covering the operating member 130/131.

The operating member 130/131 moves away and towards the body 121 as the sole 120 bends to disengage from the floor and unbends to engage the floor. The membrane 140 is moved by or with the movement of the operating member 130/131. The membrane 140 is caused to expand, as shown in FIG. 4*b*, beyond the lower surface 122 upon relative movement of at least a part 131*b*/132*b* of the operating member 131 away from the body 121 as the sole 120 bends to disengage from the floor and allow to contract to its default shape, as shown in FIG. 4*a*, when the operating member 132/133 moves towards the body 121 as the sole 120 unbends to engage the floor by the movement of the operating member 130. The expansion and contraction of the membrane 140 brings about ventilation of the aerated footwear 100.

In most embodiments, the operating member 130/131 is preferably in the form of an elongated, resilient plate.

Now turns to the fifth to the seventh embodiments of the sole 120 as shown in FIGS. 5*a* to 7*b*. The operating member 130 includes first and second operating parts 131 and 132. The first operating part 131 is preferably an elongate resilient plate. The second operating part 132 is an elongate resilient biasing member that turns upon itself, preferably an elbow spring with a pivot 137. The pivot 137 along with the one arm 132*a* of the spring 132 are preferably embedded in the intermediate portion 124 of the body 121 in the lower surface 122. Another arm 131*b* of the spring 132 extends beyond the lower surface 122 and, along its length. The first operating part 131 runs along at least part length of the arm 132*b* outside the body 121 below the lower surface 122. The second operating part 132 is positioned above the first operating part 131 when the sole 120 is in use.

Figure 5A:
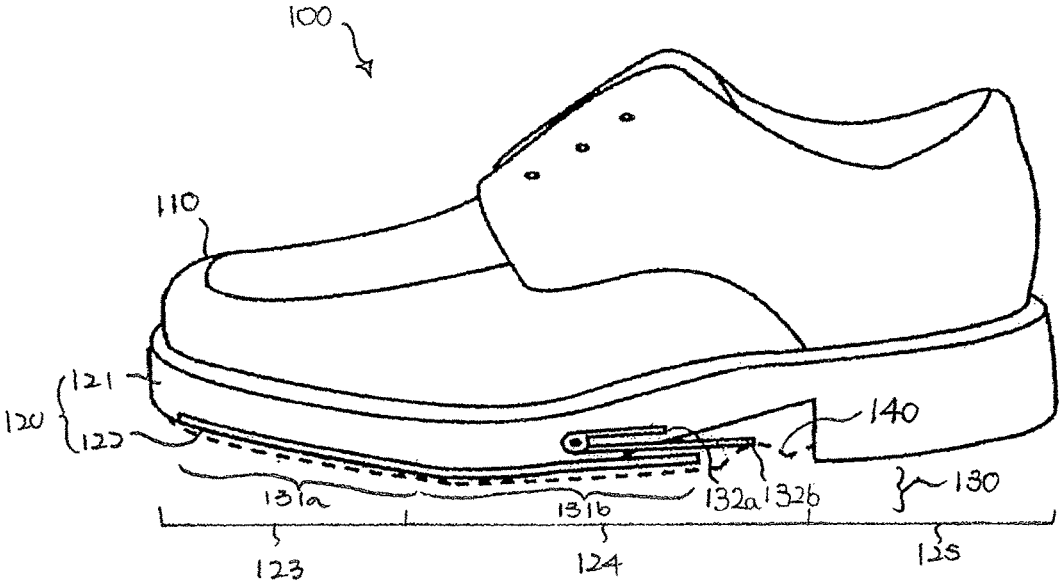
FIG. 5*a* is a side view of a fifth embodiment of a sole in accordance with the invention when the sole is unbent.
Figure 5B:
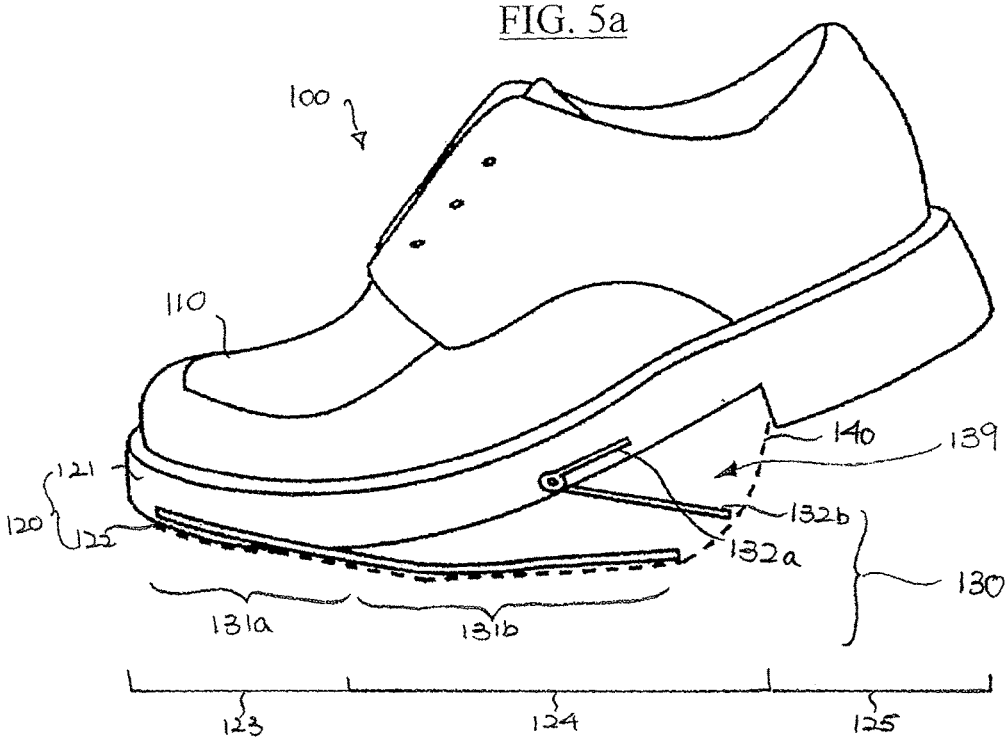
FIG. 5*b* is a side view of the sole in FIG. 5*a* when it is bent.

In FIGS. 5*a* to 5*b*, the device 140 is in the form of a membrane 140 that runs underneath and preferably covers the first and second operating parts 131 and 132. The first operating part 131 has an end portion 131*a* attached on or embedded in the lower surface 122 of the front portion 123 of the body 121. The rest of the operating part 131 is allowed to move towards and away from the body 121. The first operating part 131 of this embodiment functions generally in the same way as that in the fourth embodiment showed in FIGS. 4*a* and 4*b*.

The membrane 140 is connected to the body 121 in almost the same way as in the fourth embodiment as shown in FIGS. 4*a* and 4*b*, except that a part of the membrane 140 is attached to free end of the arm 132*b*. The membrane 140 engages, preferably covers and encloses, the first and second operating parts 131 and 132 from below.

The arm 132*b* of the spring 132 has a tendency to move away from the body 121 to its default position such that when the sole 120 bends to disengage from the floor, load to compress the spring 132 is removed, the arm 132*b* will automatically move to its default position, preferably by pivoting about the pivot 137 to move away from the arm 132*a*. The first operating part 131 also moves away from the body 121 as the sole 120 bends to disengage from the floor. Preferably, movement of the arm 132*b* away from the body 121 assists the movement of the first operating part 131 away from the body 121. The membrane 140 is caused to expand by the movement of the first operating part 131 and the arm 132*b*

When the sole 120 is unbent to engage the floor, the first operating part 131 is caused to move towards the body 121 compress the spring 132 and drives the arm 132*b* towards the arm 132*a*. The membrane 140 contracts and preferably on its own resiliency to return to its default shape. The expansion and contraction of the membrane 140 brings about ventilation of the aerated footwear 100.

Figure 6A:
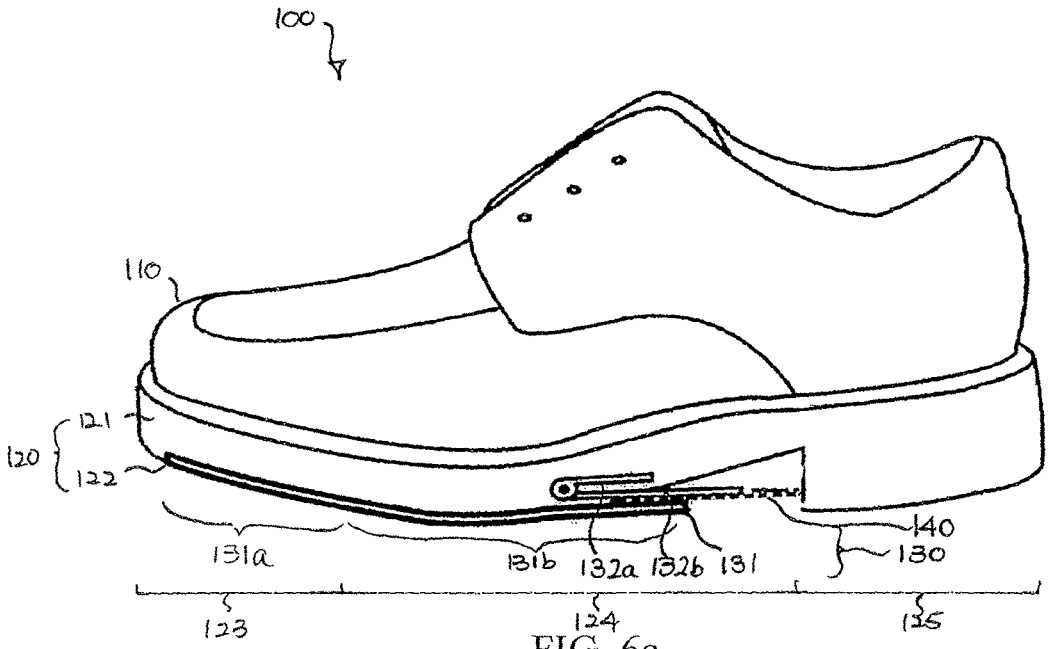
FIG. 6*a* is a side view of a sixth embodiment of a sole in accordance with the invention when the sole is unbent.
Figure 6B:
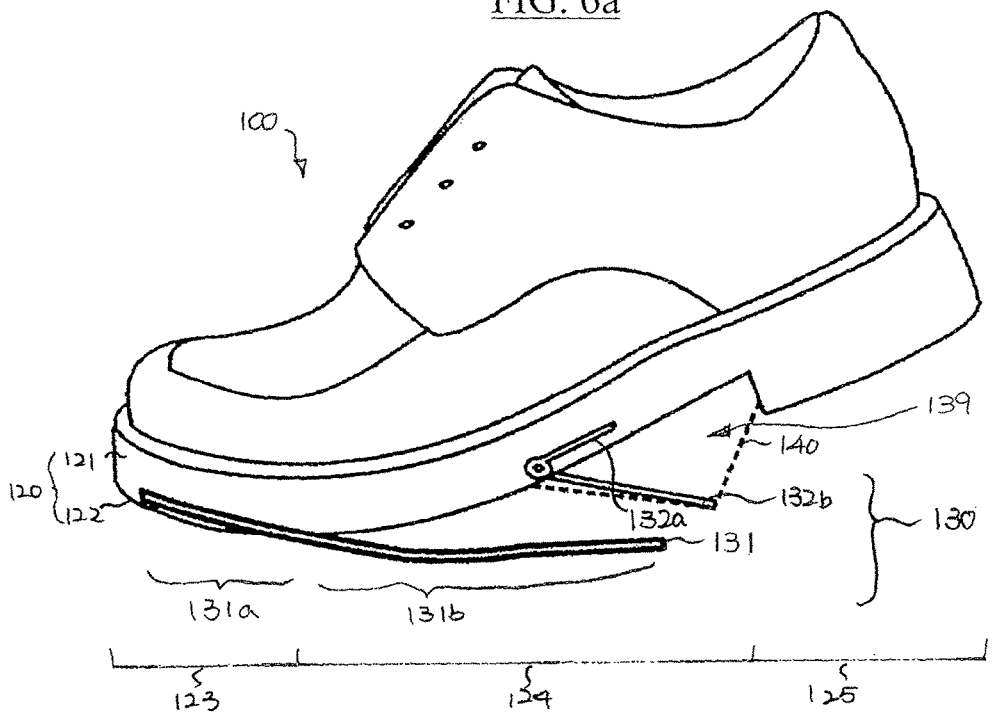
FIG. 6*b* is a side view of the sole in FIG. 6*a* when it is bent.

FIGS. 6*a* and 6*b* show a sixth embodiment of the invention. The sixth embodiment is a modification of the fifth embodiment. The membrane 140, instead of covering the whole of the first operating member 131, it engages, preferably covers and encloses, only the arm 132*b* of the second operating parts 132 to change direction of drive generated by the first operating part 131. The membrane 140 is caused to expand when the arm 132*b* moves away from the arm 132*a* as the sole 120 bends to disengage from the floor. The membrane 140 contracts to its default shape as arm 132*b* moves towards arm 132*a* upon the sole 120 unbends to engage the floor. Preferably, the membrane 140 is not attached to the free end of the arm 132*b*. The first operating part 131 and the spring 132 moves generally the same way as those in the fifth embodiment.

Figure 7A:
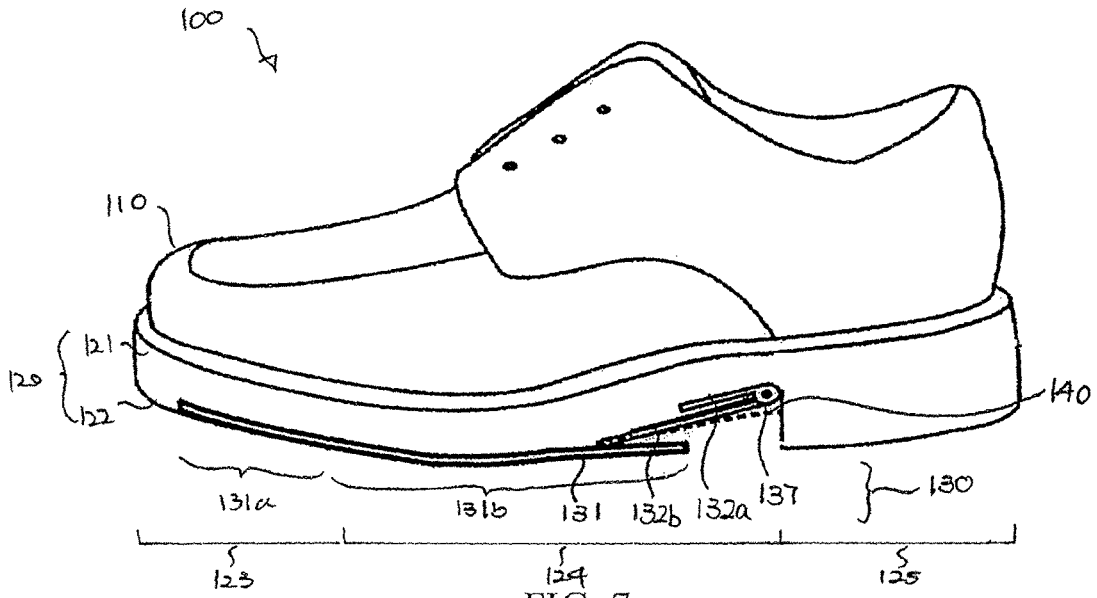
FIG. 7*a* is a side view of a seventh embodiment of a sole in accordance with the invention when the sole is unbent.
Figure 7B:
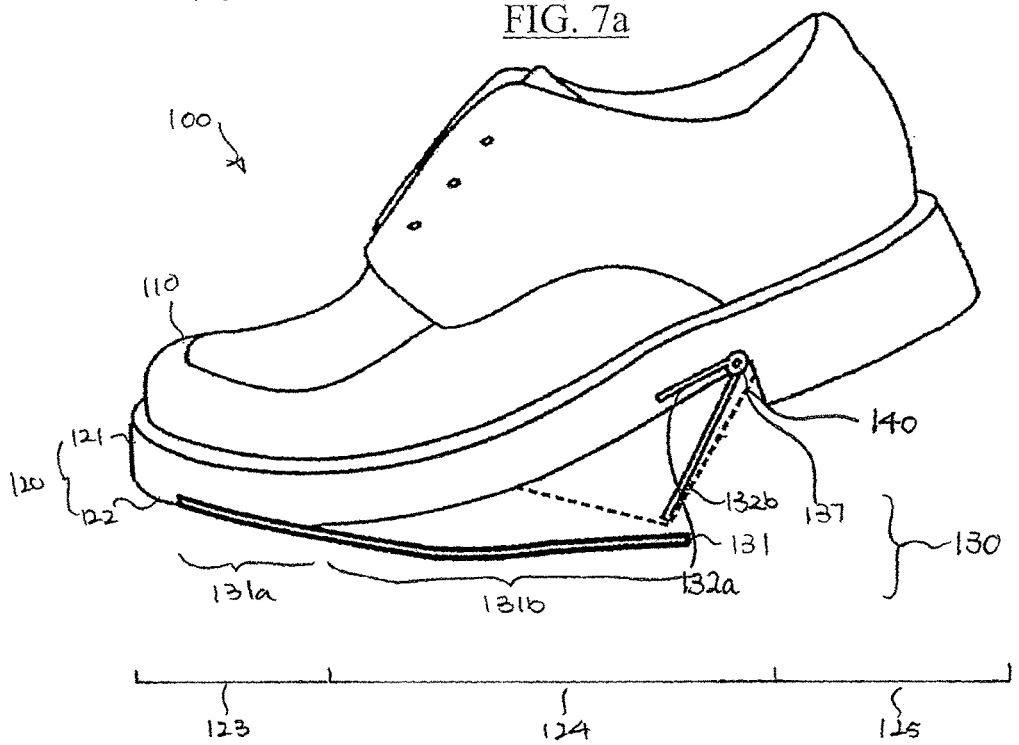
FIG. 7*b* is a side view of the sole in FIG. 7*a* when it is bent.

A seventh embodiment of the sole 120 is shown in FIGS. 7*a* and 7*b*. It is a modification of the sixth embodiment. Everything is arranged in the same way except that the spring 132 is repositioned. It is installed in an opposite manner to that as shown in the sixth embodiment with its pivot 137 placed at the junction between the heel and the front and rear portion of the sole 123 and 124. The first operating part 131 and the spring 132 function generally the same way as those in the sixth embodiment.

Alternatively, the membrane 140 may be sandwiched between the operating member 130 and the body 121 in the fourth embodiment or between the first operating part 131 and the body 121 in the second to seventh further embodiments. The membrane 140 would be attached to the operating member 130 or the first operating part 131 in order to be pulled to expand when the sole 120 bends to disengage from the floor.

Figure 8A:
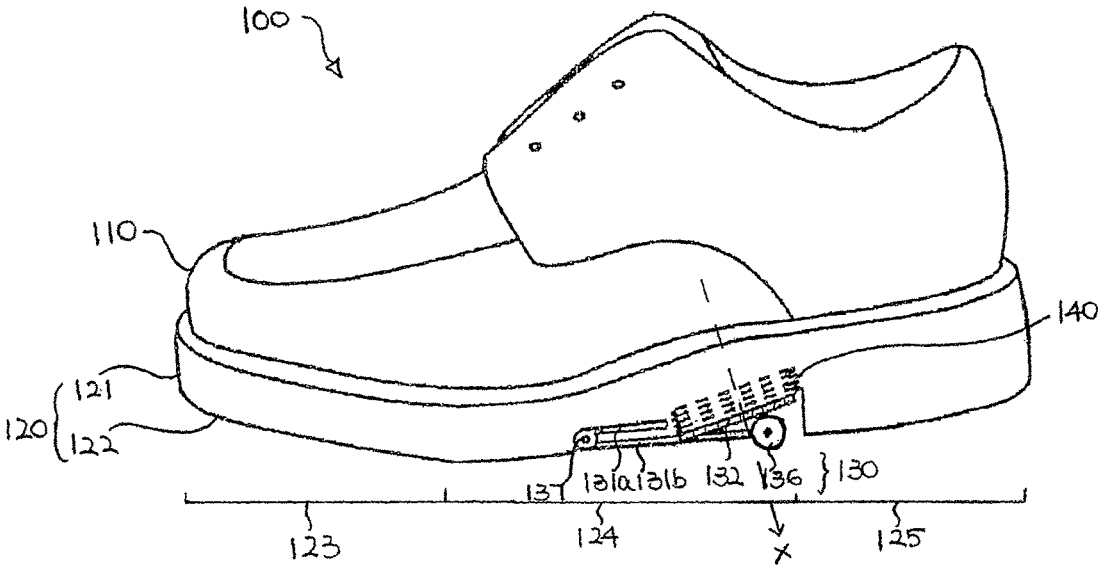
FIG. 8*a* is a side view of a eighth embodiment of a sole in accordance with the invention when the sole is unbent.
Figure 8B:
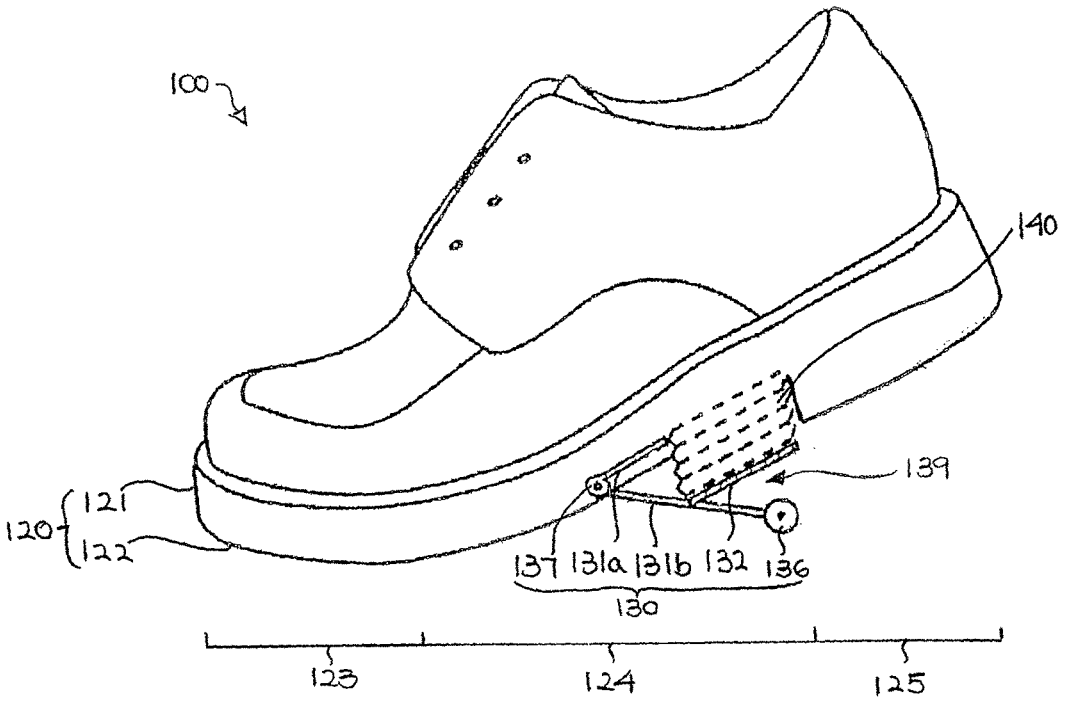
FIG. 8*b* is a side view of the sole in FIG. 8*a* when it is bent.

The eighth embodiment of the sole 120 is shown in FIGS. 8*a* and 8*b*. The operating member 130 includes first and second operating parts 131 and 132. The first operating part 131 is an elongate resilient biasing member that turns upon itself, preferably an elbow spring with a pivot 137. The pivot 137 along with the one arm 131*a* of the spring 131 are preferably embedded in the intermediate portion 124 of the body 121 in the lower surface 122. Another arm 131*b* of the spring 131 extends beyond the lower surface 122 and, along its length, it is engageable with, preferably connected to and more preferably pivotally or slidably connected to a second operating part 132 to change direction of drive generated by the arm 131*b*. The second operating part 132 is affixed or adhered to a lower surface of the pump 140 such that the pump 140 is compressed or expanded with or by movement of the arm 131*b* and the whole of the operating part 132 away from and towards the body 121, preferably in a direction transverse to the longitudinal extent of the body 121 as the sole 120 bends to disengage and unbends to engage the floor for operating the pump 140; or with or by relative movement of the body 121 away from and towards the arm 131*b* and the whole of the operating part 132 in a direction transverse to the longitudinal extent of the body 121 as the sole bends to disengage and unbends to engage a floor, for operating the pump 140. The arm 131*b* of the elbow spring 131 has a tendency to move away from the body 121 to its default position such that when the sole 120 bends to disengage from the floor, load to compress the spring 131 is removed, the arm 131*b* will automatically move to its default position in a direction transverse to the longitudinal extend of the body 121, preferably by pivoting about the pivot 137 to move away from the arm 131*a* causing the second operating part 132 to move relatively away from the body 121 in a direction transverse to the longitudinal extend of the body 121 to expand the pump 140.

When the second operating part 132 is pivotally connected to the first operating part 131, the second operating part 132 pivots relative to the first operating part 131 as the first operating parts 131 move away from and towards the body 121, preferably in a direction transverse to the longitudinal extent of the body 121 as the sole 120 bends to disengage and unbends to engage a floor.

When the second operating part 132 is slidably connected to the first operating part 131, the second operating part 132 slides along length of the first operating part 131 as the first operating part 131 move relatively away from and towards the body 121, preferably in a direction transverse to the longitudinal extent of the body 121 as the sole 120 bends to disengage and unbends to engage a floor to compress and expand the pump 140. The drive generated by the second operating part 132 is generally or substantially parallel to the main longitudinal axis X of the pump 140 towards and away from the body 121 such that, in an ideal condition, permits undistorted expansion of the pump 140 as the sole 120 bends and unbends.

Upon the sole 120 unbends to engage the floor, this forces the arm 131*b* to move relatively towards the body 121 or forces the body 121 to move relatively towards the arm 131*b* to thereby compress the pump 140. More preferably, free end of the arm 131*b* is attached to a roller or wheel 136 or any rounded surface to reduce friction between the spring 131 and the floor as the operating member 130 functions.

Figure 9A:
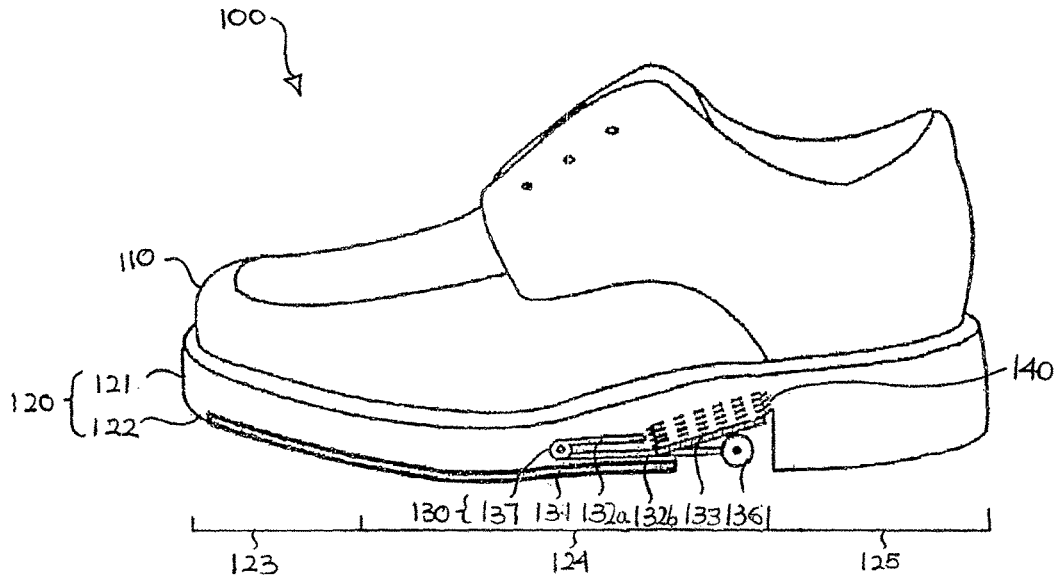
FIG. 9*a* is a side view of a ninth embodiment of a sole in accordance with the invention when the sole is unbent.
Figure 9B:
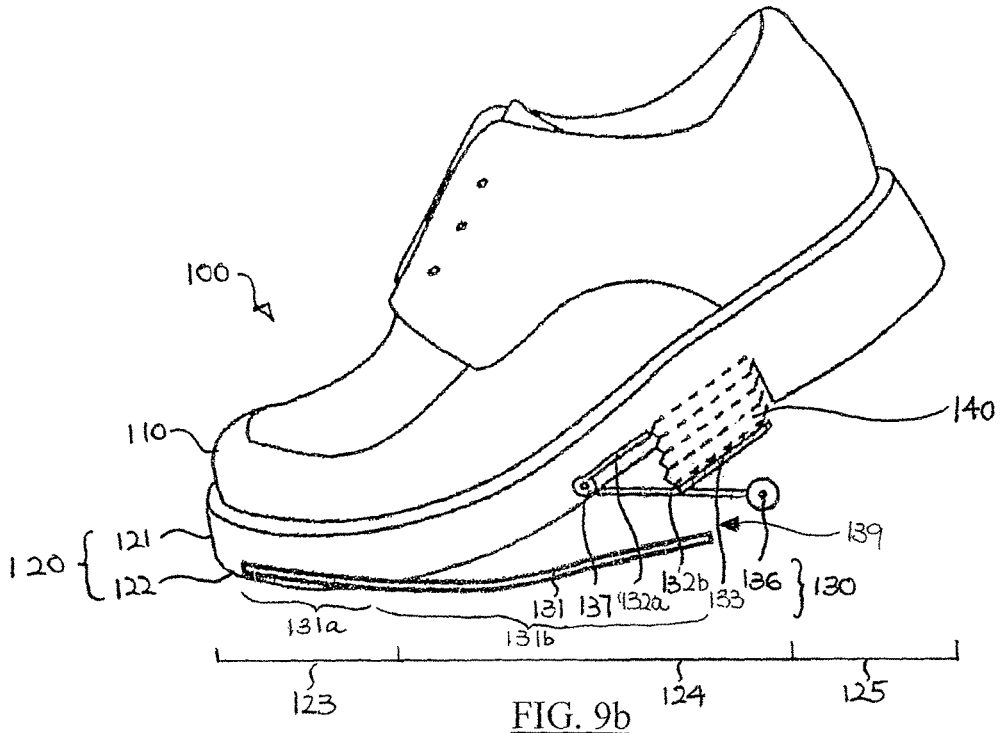
FIG. 9*b* is a side view of the sole in FIG. 9*a* when it is bent.

Referring to FIGS. 9*a* and 9*b*, there is shown a ninth embodiment of the sole 120 in accordance with the invention. It is a modification of the eighth embodiment. The operating member includes first, second and third operating parts 131, 132 and 133. The first operating part 131 has an end portion 131*a* attached on or embedded in the lower surface 122 of the front portion 123 of the body 121. The rest of the operating part 131 is allowed to move away from and towards the body 121, preferably in a direction transverse to the longitudinal extent of the body 121 as the sole 120 bends to disengage and unbends to engage a floor for operating the pump 140. The operating part 131 has an opposite end portion 131*b* extending over and preferably engageable with lower surface of the arm 132*b* of the second operating part 132 outside the body 121. The first operating part 131 of this ninth embodiment functions generally in the same way as or at least similar to that in the first embodiment.

The second operating part 132 is an elongate resilient biasing member that turns upon itself, preferably an elbow spring with a pivot 137. One arm 132*a* of the spring 132 is embedded in the intermediate portion 124 of the body 121 in the lower surface 122. Another arm 132*b* of the spring 132 extends beyond the lower surface 122 and, along its length, it is engageable with, preferably connected to and more preferably pivotally or slidably connected to a third operating part 133 to change direction of drive generated by the first operating part 131 and/or the second operating part 132. The second operating part 132 functions generally in the same way as or at least similar to the first operating part 131 of the eighth embodiment.

The third operating part 133 is movable with or by movement of the first operating part 131 and/or second operating part 132. The third operating part 133 is affixed or adhered to a lower surface of the pump 140 such that the pump 140 is compressed or expanded, with or by movement of the first operating part 131 and the arm 132*b* away from and towards the body 121, preferably in a direction transverse to the longitudinal extent of the body 121 as the sole 120 bends to disengage and unbends to engage a floor, or with or by movement of the body 121 away from and towards the first operating part 131 and the arm 132*b* preferably in a direction transverse to the longitudinal extent of the body 121 as the sole 120 bends to disengage and unbends to engage a floor.

When sole 120 unbends to engage the floor, the arm 132*b* of the elbow spring 132 and the whole of the third operating part 133 moves with or by movement of the end portion 131*b* of the first operating part 131 towards the body 121 compressing the pump 140. Or the body 121 moves relatively towards the first operating part 131, the elbow spring 132 and the third operating part 133 to compress the pump 140.

When the sole 120 bends to disengage the floor, the end portion 131*b* of the first operating part 131 and the arm 132*b* of the elbow spring 132 automatically return to their default shape and position respectively by moving away from the body 121. The whole of the third operating part 133 moves away from the body 121 with or by movement of the arm 132*b* thereby expands the pump 140.

When the third operating part 133 is pivotally connected to the arm 132*b*, the third operating part 133 pivots relative to the arm 132*b* as the first and second operating parts 131 and 132 move relatively preferably in a direction transverse to the longitudinal extent of the body 121 as the sole 120 bends to disengage and unbends to engage a floor for operating the pump 140.

When the third operating part 133 is slidably connected to the arm 132*b*, the third operating part 133 slides along length of the arm 132*b* as the first and second operating parts 131 and 132 move relatively preferably in a direction transverse to the longitudinal extent of the body 121 as the sole 120 bends to disengage and unbends to engage a floor for operating the pump 140. The drive generated by the third operating part 132 is generally or substantially parallel to the main longitudinal axis X of the pump 140 towards and away from the body 121 such that, in an ideal condition, permits undistorted expansion of the pump 140 as the sole 120 bends and unbends.

Upon movement of the operating member 130 away from the body 121, there is a gap 139 between the operating member 130 and the lower surface 122 of the body 121. The gap 139 may be covered by a covering member. The covering member covers the gap and protects it against entrance of foreign objects. The covering member also hides the operating member 130 from external environment. This covering member could be applied to any of the embodiments of sole 120.

The covering member may be a membrane extending between the lower surface 122 and the operating member 130 on all sides of the gap 139 to cover it. The membrane is resilient and elastic capable of being stretched to extend.

Edges of the membrane may be partially inserted into the lower surface 122 for anchorage.

In an alternative embodiment, the covering member may extend across whole of the lower surface 122 forming a bottommost cover. The bottommost cover may be hollow with certain thickness to accommodate the operating member 130 upon its movement away from the body 121. The gap 139 is concealed from the external environment.

Advantageously, the covering member may be membrane that covers the whole of the lower surface 122. The membrane is resilient, elastic and capable of being stretched by or with the operating member 130 upon movement away from the body 121.

In a further embodiment of the invention, the body 121 includes a lock 150 as shown in FIGS. 10*a* to 17*b*. Two embodiments of the lock 150 are disclosed in FIGS. 10*a* to 11*b* and 12*a* to 13*b* respectively.

Figure 10A:
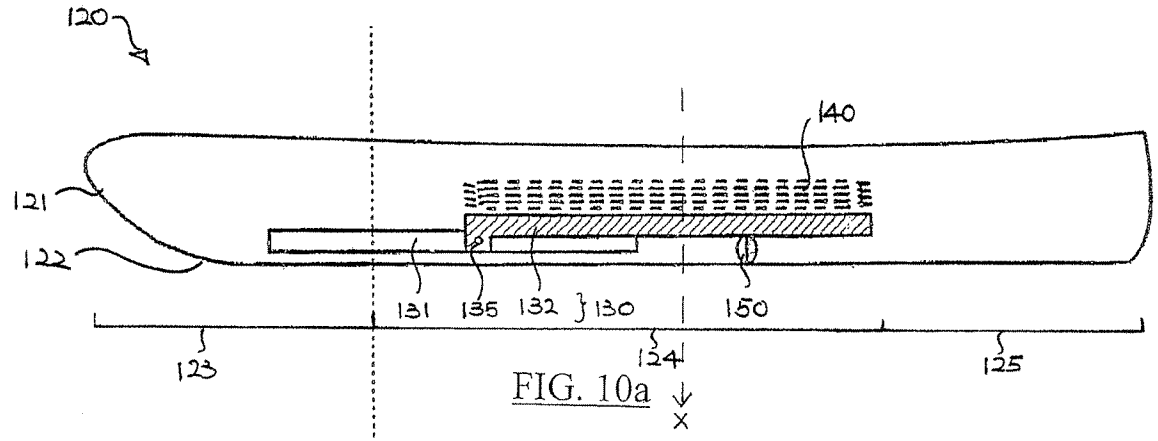
FIG. 10*a* is a longitudinal cross-sectional view of the sole in FIG. 2*a* when it is unbend with a first embodiment of a lock in its locking position/locked state, locking a drive generator.
Figure 10B:
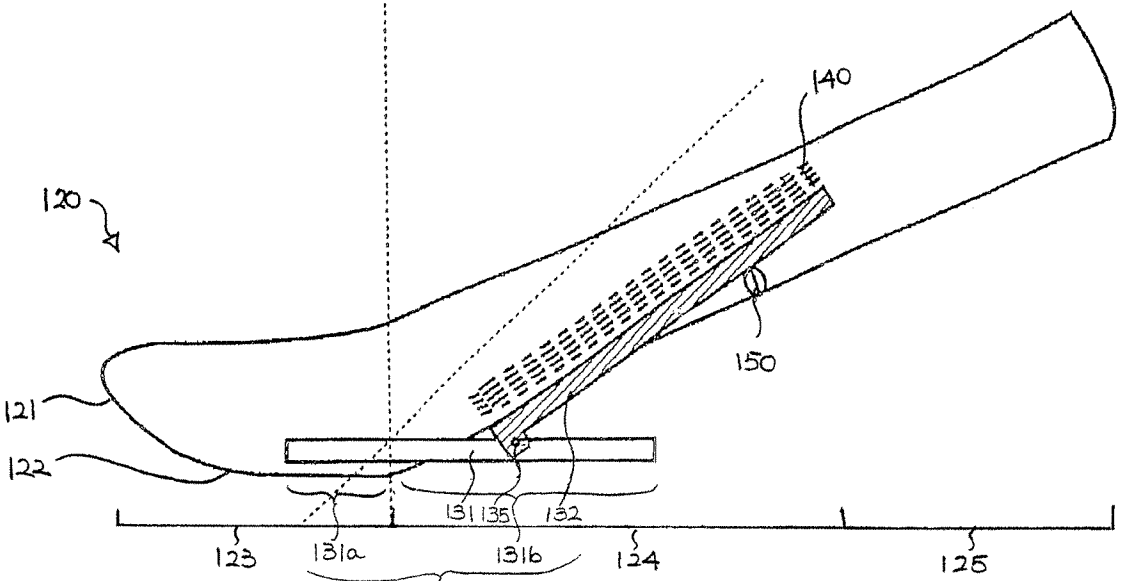
FIG. 10*b* is a longitudinal cross-sectional view of the sole in FIG. 2*b* when it is bent with the lock in its locking position/locked state, locking the drive generator in FIG. 10*a;*

FIGS. 10*a* and 10*b* shows the second embodiment of the sole 120 implementing the first embodiment of the lock 150. The lock 150, at its locking position/locked state, prevent movement of the second operating part 132 away from the body 121 when the sole 120 bends and unbends. This prevents the pump 140 from expanding.

Figure 11A:
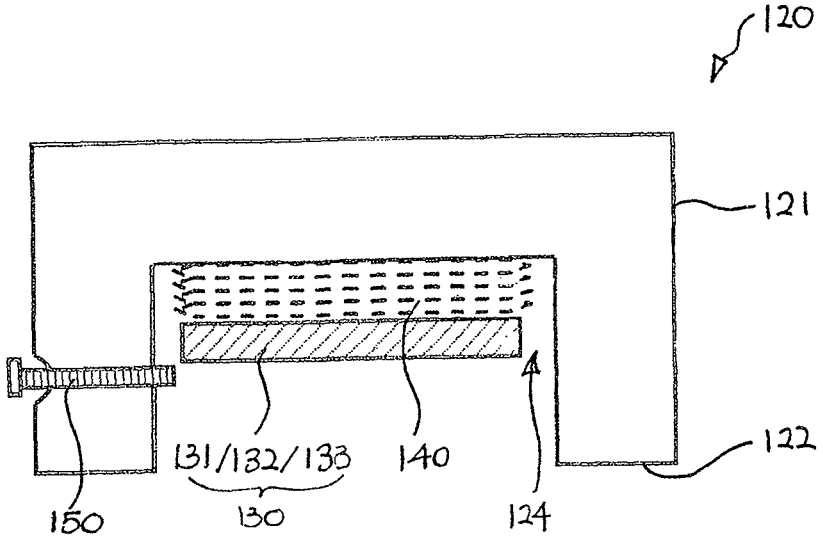
FIG. 11*a* is a cross-sectional view of the sole in FIG. 1*a* or 2*a* taken along its width, showing the lock in FIGS. 10*a* and 10*b* in an unlocking position/unlock state, unlocking the drive generator.
Figure 11B:
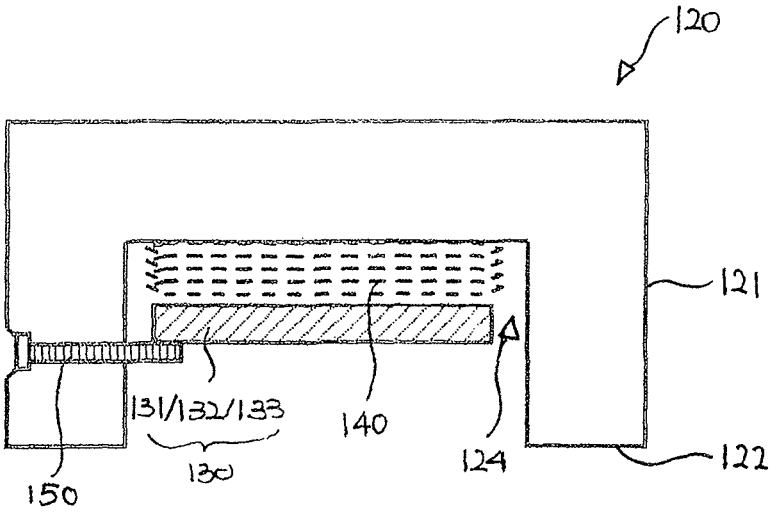
FIG. 11*b* is a cross-sectional view of the sole in FIG. 1*a* or 2*a* taken along its width, showing the lock in FIGS. 10*a* and 10*b* in its locking position/locked state.

The pump is preferably a cylindrical, rectangular or trapezoidal prismatic shaped pump Referring to FIGS. 11*a* and 11*b*, the lock 150 is a sliding lock, preferably a threaded screw which can be screwed towards and away from the pump 140. The screw 150 goes underneath the operating member 130 when it is slid to its locking position/locked state as shown in FIG. 11*b* and is slidable to its unlocking position/unlock state, away from the pump 140 and the second operating part 132, to thereby release the second operating part 132.

The lock is presented by way of example only and can readily be applied to other embodiments of the sole.

Figure 12A:
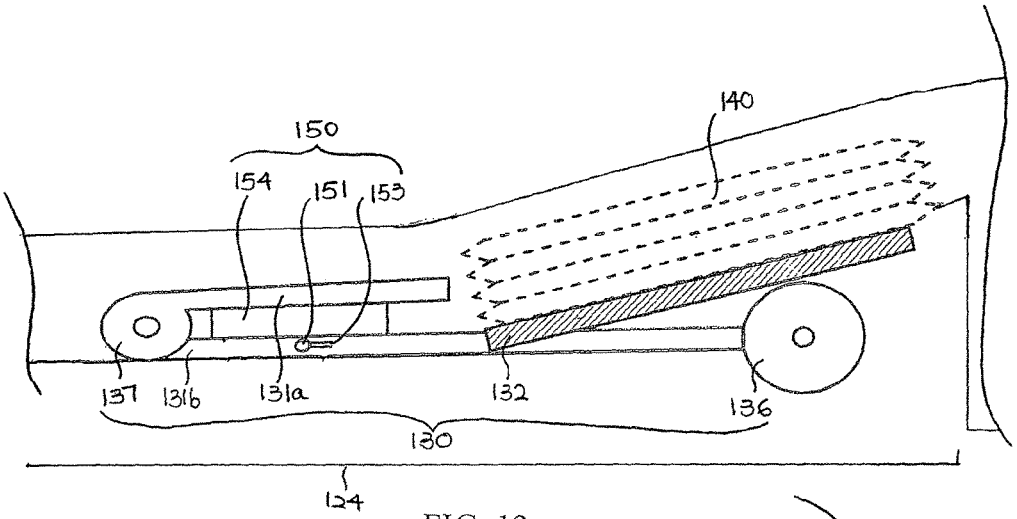
FIG. 12*a* is a longitudinal cross-sectional view of a part of the sole in FIG. 8*a* when it is unbend, with a second embodiment of a lock in its locking position/locked stated, locking a drive generator.
Figure 12B:
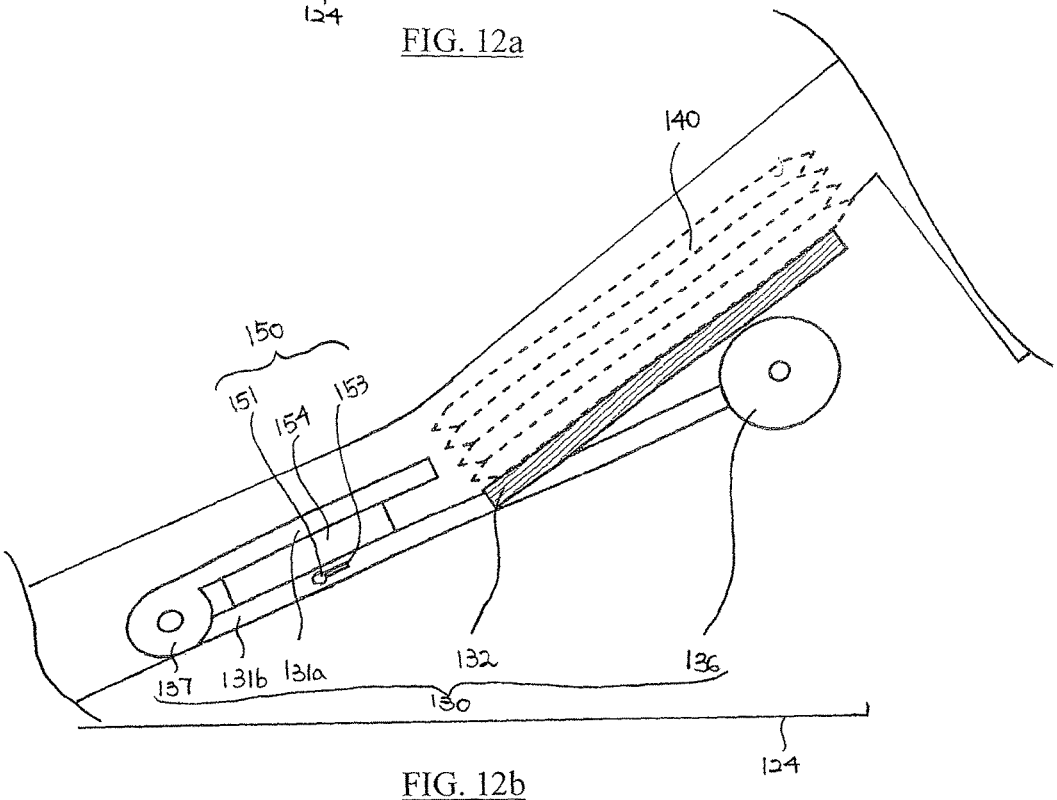
FIG. 12*b* is a longitudinal cross-sectional view of the part of the sole in FIG. 12*a* when it is bend, with the lock in FIG. 12*a* in its locking position/locked stated

FIGS. 12*a* and 12*b* show an embodiment of the sole 120 implementing the second embodiment of the lock 150. The lock 150 locks the arm 131*a* and 131*b* of the first operating part together, thereby preventing the arm 131*b* from biasing away from the body 121 when the sole 120 bends and flattens. This, in turn, prevents expansion of the pump 140 by pressing the second operating part 132 relatively towards the pump 140.

Figure 13A:
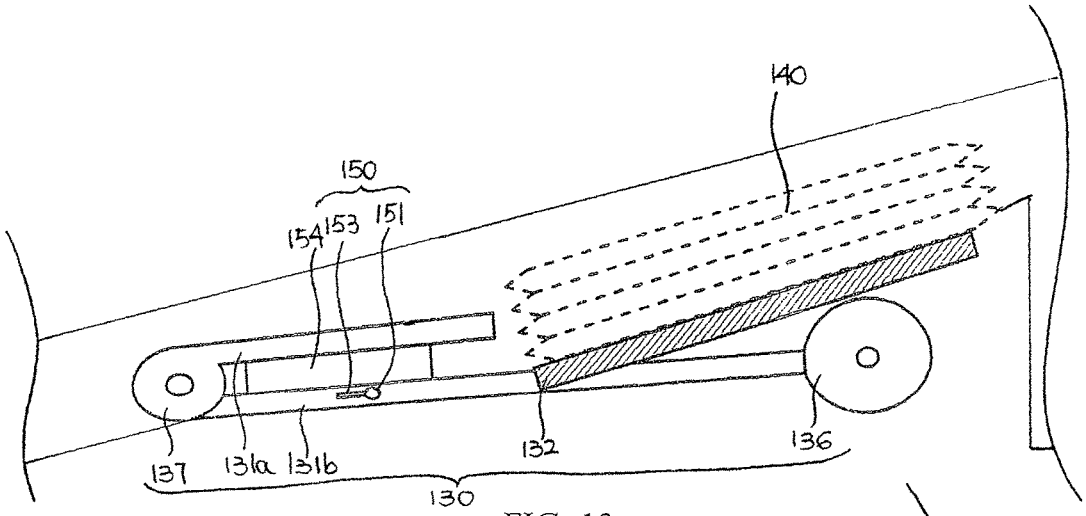
FIG. 13*a* is a longitudinal cross-sectional view of the part of the sole in FIG. 12*a* with the lock as shown in FIGS. 12*a* and 8*b* in an unlocking position/unlock state.
Figure 13B:
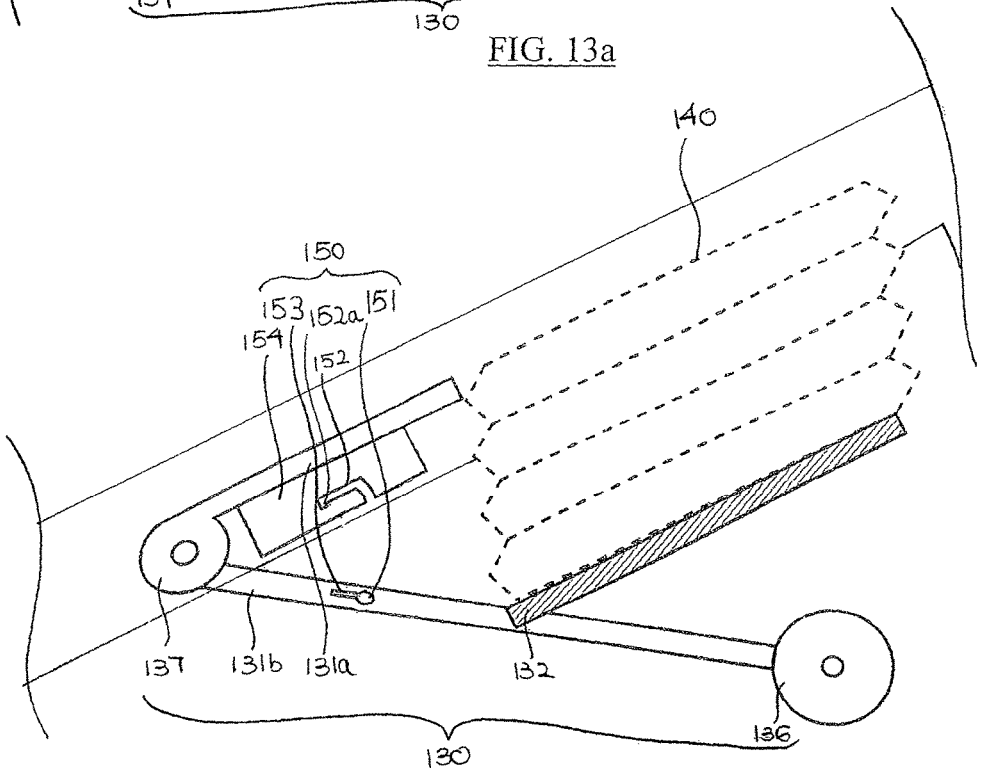
FIG. 13*b* is a longitudinal cross-sectional view of the part of the sole in FIG. 12*b* with the lock as shown in FIG. 13*a*, which is in an unlocking position/unlock state.

Referring to FIGS. 13*a* and 13*b*, the lock 150 includes a stud 151, a slot 152 on an extension 154 of the arm 131*a*, preferably extending downwardly in a direction away from the body 121, and a slot 153 on the aim 131*b*. The stud 151 is maintained inserted in and slidable along the slot 153 which is preferably an "I" shaped slot extending along length of and on the aim 131*b*. The slot 152 is generally an "L" shaped slot with its longer side extending along length of the extension 154. To lock aims 131*a* with the arm 131*b*, the stud 151 is first moved to its unlocking position/unlock state in FIG. 13*a*. The stud 151 passes a shorter side of the slot 152, in an upward direction towards the body 121, as the slots 152 and 153 are aligned. The stud 151 is then slid in a direction towards the pivot 137. Then, the aim 131*b* is allowed to move slightly away from the body 121/arm 131*a*, such that the stud 151 can move to or fall into an end hook 152*a* of the slot 152. The lock 150 is in its locking position/locked position as shown in FIG. 12*a* and 12*b*. The reverse will release the stud 151 and hence the arm 131*b* from the arm 131*a*.

FIGS. 14*a* to 16*b* shows a second embodiment of the sole 120 implementing a third embodiment of the lock 150. The lock 150 is preferably a threaded screw 156, which can be rotated along its longitudinal axis, connected to an elongate member, preferably a thread, a string or a cable 157. The thread 157 is attached to or connects with the operating member 130 or bottom of the pump 140 at one end and the screw 156 at another end. The length of the thread 157 extending between the screw 156 and the operating member 130 limits the extent to which the pump 140 is expandable.

Upon bending of the sole 121, the pump 140 is allowed to expand to an extent substantially equal to the length of the thread 157 extending between the screw 156 and the operating member 130 or the bottom of the pump 140, until the thread 157 is taut.

Figure 15A:
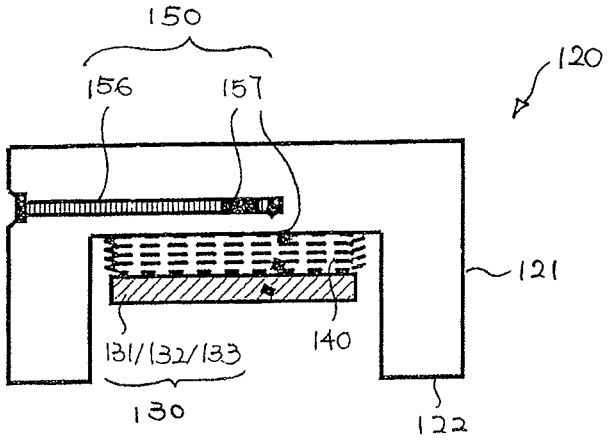
FIG. 15*a* is a cross sectional view of the sole taken along its width, showing the third embodiment of the lock in FIG. 14*a* being adjusted and when the sole is unbent.
Figure 15B:
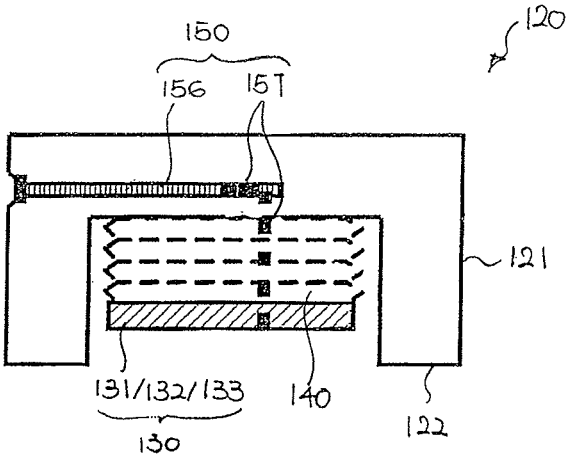
FIG. 15*b* is a cross sectional view of the sole taken along its width, showing the third embodiment of the lock in FIG. 15*a* when the sole is bent.

Referring to FIGS. 15*a* and 15*b*, the lock 150 is adjustable to control the extent to which the pump 140 is expandable when the sole 120 bents. By rotating the screw 156 anti-clockwise, the thread 157 reels on the screw 156. This reduces the length of the thread 157 extending between the screw 156 and the operating member 130 or the bottom of the pump 140, thereby limiting the extent to which the pump 140 can be expanded. The screw 156 may be rotated clockwise to un-reel the thread 157, thereby permitting the pump 140 to be expanded to a relatively greater extent.

Figure 14A:
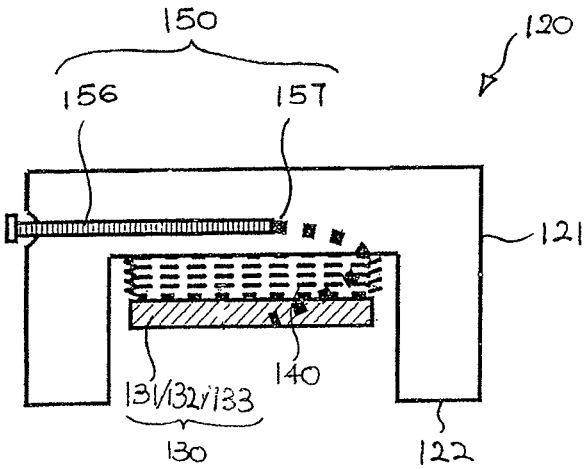
FIG. 14*a* is a cross sectional view of the sole taken along its width, showing a third embodiment of a lock when the sole is unbent.
Figure 14B:
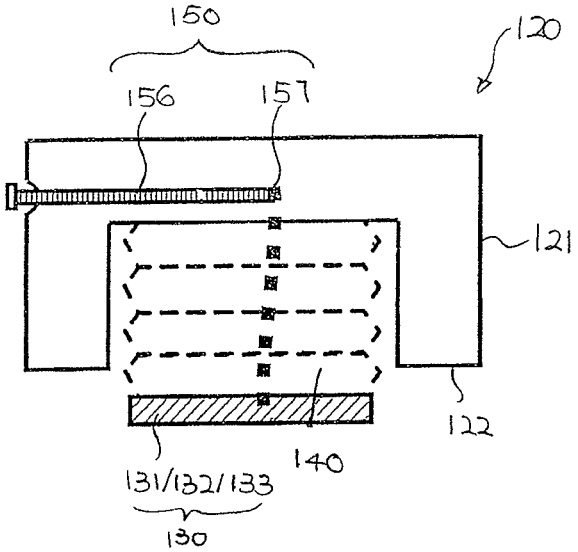
FIG. 14*b* is a cross sectional view of the sole taken along its width, showing the third embodiment of the lock in FIG. 14*a* when the sole is bent.
Figure 16A:
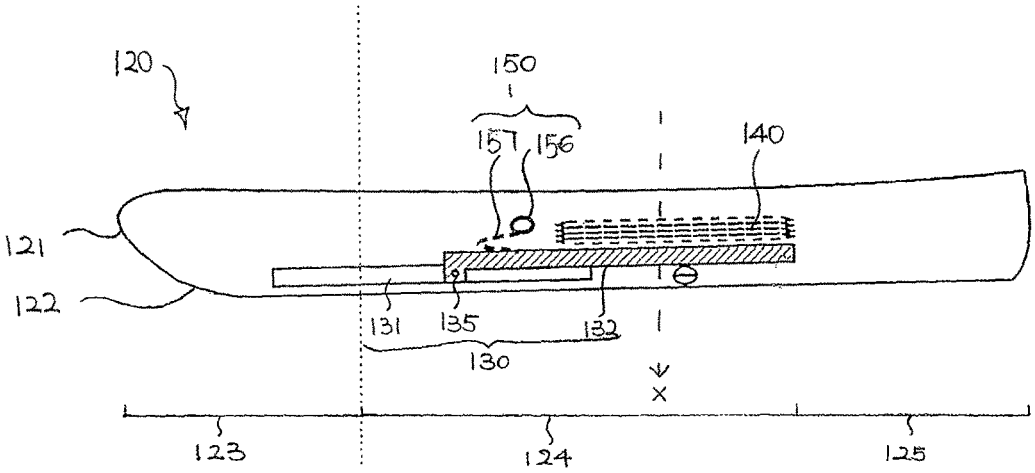
FIG. 16*a* is a longitudinal cross-sectional view of the sole in FIG. 2*a* when it is unbend, with a fourth embodiment of the lock.
Figure 16B:
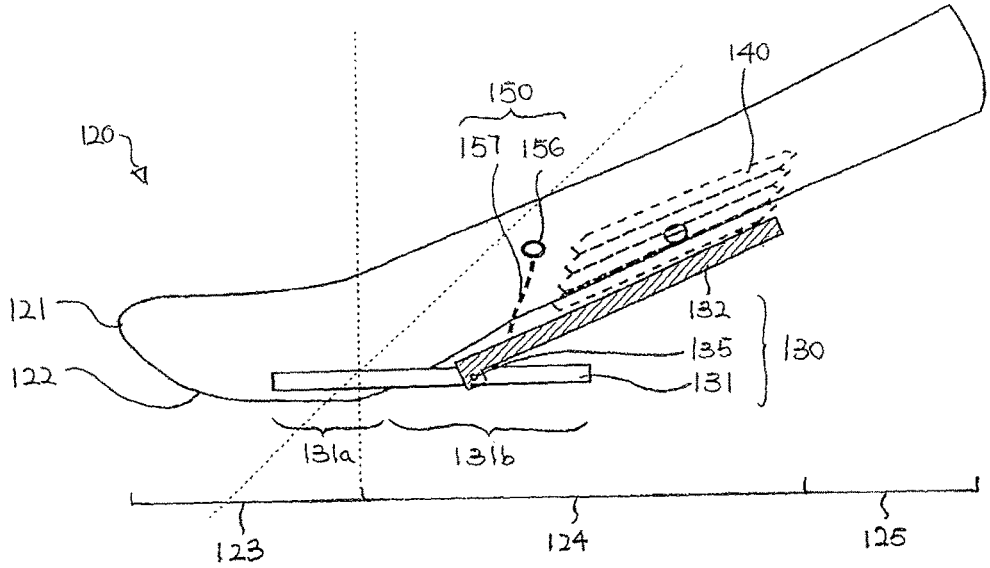
FIG. 16*b* is a longitudinal cross-sectional view of the sole in FIG. 2*a* when it is bent, with the fourth embodiment of the lock in FIG. 16*a;*

As shown in FIGS. 14*a* to 14*b*, the thread 157 may pass through the pump 140 to reach the operating member 130 or the bottom of the pump 140. In another embodiment as shown in FIGS. 16*a* and 16*b*, the thread 157 may connect to the second operating part 132 directly without passing through the pump 140.

Figure 17A:
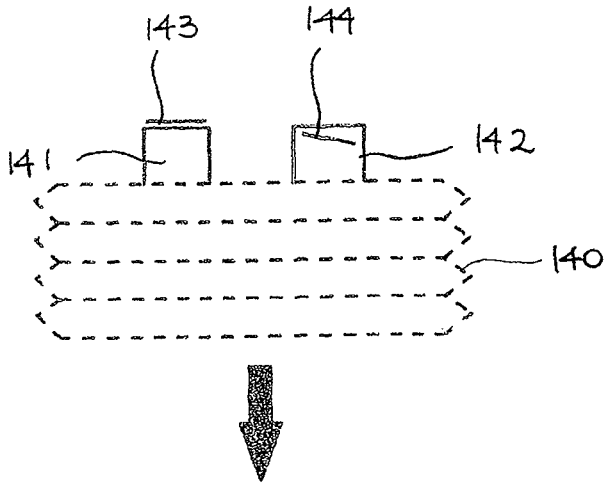
FIG. 17*a* is a cross sectional schematic illustration of a device having two valves.
Figure 17B:
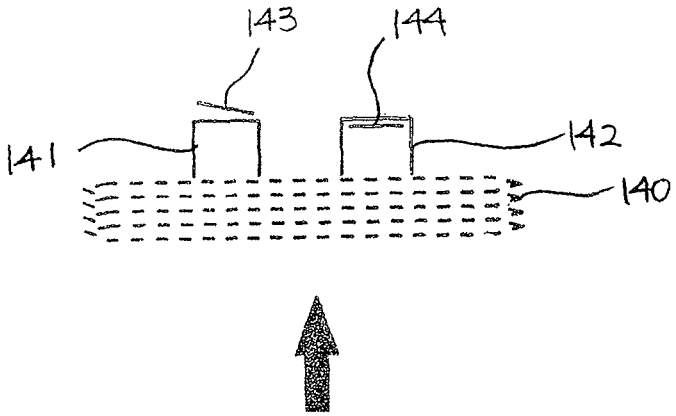
FIG. 17*b* is a cross sectional schematic illustration of the device in FIG. 14*a* with one of the valves in an opened state.

In a preferred embodiment as shown in FIGS. 17*a* and 17*b*, the pump 140 has inlet/opening and outlet/opening 141 and 142 guarded by two valves 143 and 144 to allow air in and out of the pump 140 as it expands and compresses. The valves 143 and 144, preferably flap valves, are opened to inside of the footwear 100 such that there is no need of an opening leading to outside of the footwear 100 in the sole 120. This prevents foreign objections, such as water, from entering the sole 120 from outside the footwear 100.

In a further aspect of the invention, there is disclosed a method of assembling a sole for aerated footwear. The method includes the steps of providing a elongate body 121 with a lower surface 122, a device 140, which is preferably a pump or a membrane and an operating member 130 for operating the device 140. The device 140 is attached to or embedded in the lower surface 122 of the body 121. Preferably the device 140 is attached to or embedded in at least partly in the lower surface 122. First end of the operating member 130 is attached to a part of the body 121. An opposite second end of the operating member 130 is engageable with the device 140. The operating member 130 is arranged to move away from and towards the body 121 in a direction transverse to the longitudinal extent of the body 121 as the sole bends to disengage and unbends to engage a floor, for operating the device 140. The device 140 is expandable from or further from the lower surface 122 of the body 121 upon movement of the operating member 130 away from the body 121.

In all of the embodiments, the drive members and/or device may be made of various plastics, metals and materials including but not limited to Ethylene Vinyl Acetate (EVA), nylon, nylon 6, nylon 6-6, acrylonitrile butadiene styrene (ABS), acrylic, Polybutylene terephthalate (PBT), polycarbonate (PC), polypropylene (PP), Poly phenylene sulphide (PPS), polyethylene terephthalate (PET), thermoplastic polyurethanes (TPU), thermoplastic rubber (TPR), carbon fibre, graphite, aluminium, steel, iron, or a combination of such.

It should be appreciated that modifications and alterations to the described embodiments obvious to those skilled in the art of sole for aerated footwear, manufacture and use, should not be considered as beyond the scope of the present invention.

For example, in the second embodiment, the second operating part may be slidable connected to the first operating part to slide along length of the first operating part as both operating members moves towards and away from the body.

For example, in all the embodiments, the operating parts may be rotatably connected to one another.

For example, the lock may have a number of locking positions/locked states, permitting the pump to expand to different extent when the lock is at different locking positions/locked states.

For example, the device may be fitted in many areas along the length of the sole both closer to the heel and closer to the front of the sole.

For example, the operating member, the first, second and third operating parts may not be attached but engageble to the device.

For example, the sole may include a covering that hides or makes the bottom less distinguishable.

The invention claimed is:

1. A sole for aerated footwear, the sole comprising:

an elastic elongate body having a front portion, a rear portion, and an intermediate portion located between and joining the front portion and the rear portion along a longitudinal direction of the elongated body, wherein the rear portion of the elongate body includes a lower surface configured for contacting a floor when the sole is part of the aerated footwear;

an elastic membrane, attached to the lower surface of the elongate body; and a substantially inelastic operating member having opposed first and second ends, wherein the operating member extends from the front portion of the elongate body toward the rear portion of the elongate body, the first end of the operating member is attached to or embedded in the front portion of the elongate body, the second end of the operating member is engageable with the membrane and is movable toward and away from the elongate body, the operating member is interposed between the elongate body and the membrane, with the second end of the operating member bearing on the membrane, when the front portion of the elongate body bends relative to the rear portion of the elongate body so that the elongate body is not relatively flat, the second end of the operating member moves away from the elongate body, and when the front portion of the elongate body flattens relative to the rear portion of the elongate body, the second end of the operating member moves toward the elongate body; and the membrane is moveable by or with the operating member upon bending of the front portion of the elongate body relative to the rear portion of the elongate body.

2. The sole for aerated footwear as claimed in claim 1, wherein the operating member is a material selected from a the group consisting of EVA, nylon, nylon 6, nylon 6-6, ABS, acrylic, PBT, PC, PP, PPS, PBT, PET, TPU, TPR, carbon fibre, graphite, aluminium, steel, and iron.

3. The sole for aerated footwear as claimed in claim 1, wherein the operating member moves away and toward the elongate body, in a direction transverse to the longitudinal direction of the elongate body, as the sole bends and unbends.

4. The sole for aerated footwear as claimed in claim 1, wherein the membrane is attached to a tip of the elongate body.

5. The sole for aerated footwear as claimed in claim 1, comprising resilient biasing means biasing the second end of the operating member away from the elongate body.

6. The sole for aerated footwear as claimed in claim 5, wherein the resilient biasing means includes an elbow spring.

7. The sole for aerated footwear as claimed in claim 1, wherein the membrane is attached to and extends between a tip of the front portion of the elongate body and the rear portion of the elongate body, covering and enclosing the operating member, upon bending of the front portion of the elongate body relative to the rear portion of the elongate body, movement of the second end of the operating member away from the elongate body stretches the membrane, and upon flattening of the front portion of the elongate body relative to the rear portion of the elongate body, and movement of the second end of the operating member toward the elongate body, the membrane contracts.

8. A sole for aerated footwear, the sole comprising:

a flexible elongate body having a front portion, a rear portion, and an intermediate portion located between and joining the front portion and the rear portion, wherein the rear portion of the elongate body includes a lower surface configured for contacting a floor when the sole is part of the aerated footwear;

a substantially inelastic operating member having opposed first and second ends, wherein the first end of the operating member is attached to or embedded in the front portion of the elongate body and the second end of the operating member extends toward the rear portion of the elongate body, is a free end that is not attached to the elongate body, and is movable toward and away from the movable body; and an elastic membrane having opposed first and second ends, wherein the first end of the membrane is attached to the front portion of the elongate body, the second end of the membrane is attached to the rear portion of the elongate body, the operating member is interposed between the elongate body and the membrane, with the second, free end of the operating member bearing on the membrane intermediate the first and second ends of the membrane, and when the front portion of the elongate body bends relative to the rear portion of the elongate body so that the elongate body is not relatively flat, the second end of the operating member moves away from the elongate body and stretches the membrane, and when the front portion of the elongate body flattens relative to the rear portion of the elongate body, the second end of the operating member moves toward the elongate body and the membrane contracts.

9. The sole for aerated footwear as claimed in claim 8, wherein the operating member is a material selected from a the group consisting of EVA, nylon, nylon 6, nylon 6-6, ABS, acrylic, PBT, PC, PP, PPS, PBT, PET, TPU, TPR, carbon fiber, graphite, aluminum, steel, and iron.

10. The sole for aerated footwear as claimed in claim 8, wherein the first end of the membrane is attached to a tip of the front portion of the elongate body.

11. The sole for aerated footwear as claimed in claim 8, comprising resilient biasing means biasing the second end of the operating member away from the elongate body.

12. The sole for aerated footwear as claimed in claim 11, wherein the resilient biasing means includes an elbow spring.

13. The sole for aerated footwear as claimed in claim 8, wherein the membrane covers and encloses the operating member.

14. A sole for aerated footwear, the sole comprising:

an elongate body having a front portion, a rear portion, and an intermediate portion located between and joining the front portion and the rear portion, and a lower surface, wherein the rear portion of the elongate body includes a lower surface configured for contacting a floor when the sole is part of the aerated footwear;

a membrane, attached to the lower surface of the elongate body; and an operating member having opposed first and second ends, wherein the operating member extends from the front portion of the elongate body toward the rear portion of the elongate body, the first end of the operating member is attached to or embedded in the lower surface of the elongate body at the front portion, the second end of the operating member is engageable with the membrane and is movable toward and away from the lower surface of the elongate body, the membrane covers and encloses the operating member, the membrane is attached to a tip of the elongate body, when the front portion bends relative to the rear portion so that the lower surface of the elongate body is not relatively flat, the second end of the operating member moves away from the lower surface and stretches the membrane, and when the front portion flattens relative to the rear portion so that the lower surface is relatively flat, the operating member moves toward the lower surface and the membranes contracts; and the membrane is moveable by or with the operating member upon bending of the front portion relative to the rear portion.

15. The sole for aerated footwear as claimed in claim 14, wherein the operating member is a material selected from a the group consisting of EVA, nylon, nylon 6, nylon 6-6, ABS, acrylic, PBT, PC, PP, PPS, PBT, PET, TPU, TPR, carbon fiber, graphite, aluminum, steel, and iron.

16. The sole for aerated footwear as claimed in claim 14, wherein the membrane is resilient.

17. The sole for aerated footwear as claimed in claim 14, wherein the operating member is substantially inelastic.

18. The sole for aerated footwear as claimed in claim 14, wherein the operating member comprises an elongated, resilient plate.

19. The sole for aerated footwear as claimed in claim 14, comprising resilient biasing means biasing the second end of the operating member away from the elongate body.

20. The sole for aerated footwear as claimed in claim 19, wherein the resilient biasing means includes an elbow spring.

* * * * *